US009828769B2

(12) United States Patent
AribaŞet al.

(10) Patent No.: US 9,828,769 B2
(45) Date of Patent: Nov. 28, 2017

(54) FOLDABLE BRICK WITH ROPE ATTACHMENTS AND DETACHABLE WALL BUILDING SYSTEM

(71) Applicant: HOBİ ENDÜSTRİYEL ÜRÜN TASARIM UYGULAMA ÜRETİM İTHALAT İHRACAT LİMİTED ŞİRKETİ, Istanbul (TR)

(72) Inventors: Adem Aribaş, Istanbul (TR); Mustafa Gürçağ Özler, Istanbul (TR)

(73) Assignee: HOBI ENDÜSTRIYEL ÜRÜN TASARIM UYGULAMA ÜRETIM ITHALAT IHRACAT LIMITED SIRKETI, Istanbul (TR)

( * ) Notice: Subject to any disclaimer, the term of this patent is extended or adjusted under 35 U.S.C. 154(b) by 0 days.

(21) Appl. No.: 15/034,550

(22) PCT Filed: Dec. 5, 2014

(86) PCT No.: PCT/TR2014/000486
§ 371 (c)(1),
(2) Date: May 5, 2016

(87) PCT Pub. No.: WO2015/084284
PCT Pub. Date: Jun. 11, 2015

(65) Prior Publication Data

US 2016/0281357 A1 Sep. 29, 2016

(30) Foreign Application Priority Data

Dec. 6, 2013 (TR) ..... a 2013 14327
Apr. 8, 2014 (TR) ..... a 2014 04053

(51) Int. Cl.
*E04C 1/40* (2006.01)
*E04B 2/44* (2006.01)
(Continued)

(52) U.S. Cl.
CPC ..... *E04C 1/40* (2013.01); *E04B 1/88* (2013.01); *E04B 2/14* (2013.01); *E04B 2/18* (2013.01);
(Continued)

(58) Field of Classification Search
CPC ..... E04B 2/02; E04B 2/00; E04B 2/42; E04B 2/44; E04B 2002/0206; E04B 1/02;
(Continued)

(56) References Cited

U.S. PATENT DOCUMENTS 2,061,486 A 11/1936 Schuh
3,665,669 A 5/1972 Huber
(Continued)

FOREIGN PATENT DOCUMENTS

DE 4208193 A1 9/1993
EP 0206502 A2 12/1986
(Continued)

*Primary Examiner* — Adriana Figueroa
*Assistant Examiner* — Jessie Fonseca
(74) *Attorney, Agent, or Firm* — Gokalp Bayramoglu

(57) ABSTRACT

The invention is about a modular foldable brick that enables architectural elements such as stacked walls, arches, corners, doors, windows and wall niches to be constructed at indoor and outdoor conditions that divides, restricts and secures a certain space; Due to the possibility of folding the storing and carrying of this brick is possible at a minimum weight. The brick is connectable within itself and also attachable to others for constructing architectural elements as wall building systems. The foldable brick provides a foldable brick body that forms the outer walls and an inner wall being formed with three techniques; connecting/fixing (A-B groups)/encircling (C group). All three techniques are related to the forming of the detachable wall building system's entity unit foldable and sustainable brick. All these three techniques are used simultaneously.

19 Claims, 20 Drawing Sheets

(51) Int. Cl.

| | |
|---|---|
| ***E04B 2/40*** | (2006.01) |
| ***E04B 2/14*** | (2006.01) |
| ***E04B 2/18*** | (2006.01) |
| ***E04C 1/00*** | (2006.01) |
| ***E04B 1/88*** | (2006.01) |
| ***E04B 2/20*** | (2006.01) |
| ***E04B 5/00*** | (2006.01) |

(52) U.S. Cl.
CPC ..... *E04B 2/20* (2013.01); *E04B 2/40* (2013.01); *E04B 2/44* (2013.01); *E04C 1/00* (2013.01); *E04C 1/24* (2013.01)

(58) Field of Classification Search
CPC ..... E04B 1/12; E04B 2/8635; E04B 2/8641; E04B 2002/8694; E04B 1/40; E04C 1/40; E04C 3/29
See application file for complete search history.

(56) References Cited

U.S. PATENT DOCUMENTS 3,702,520 A * 11/1972 Huber ..... E04C 1/40 229/915
4,608,799 A 9/1986 Hasegawa
6,138,426 A 10/2000 Mork
6,672,799 B2 * 1/2004 Earl ..... E02B 3/108 404/6
8,756,894 B2 * 6/2014 Swartz ..... A63H 33/062 446/109
8,959,865 B2 * 2/2015 Kratz ..... E04B 2/02 405/16
9,163,393 B2 * 10/2015 Carroll ..... E04H 1/00
2003/0192272 A1 * 10/2003 Bravinski ..... E04B 2/8635 52/309.11
2007/0130873 A1 * 6/2007 Fisher ..... E04B 2/18 52/596
2007/0160423 A1 * 7/2007 Heselden ..... E02D 17/18 405/19
2011/0107706 A1 * 5/2011 Fleishman ..... E04B 2/06 52/574
2011/0265414 A1 * 11/2011 Ciccarelli ..... E04B 2/8635 52/426
2016/0153183 A1 * 6/2016 Richter ..... E04B 1/3431 52/79.5

FOREIGN PATENT DOCUMENTS

| | | | |
|---|---|---|---|
| EP | 0960585 | A2 | 12/1999 |
| EP | 1424452 | A1 | 6/2004 |
| FR | 2630478 | A2 | 10/1989 |
| GB | 2304745 | A | 3/1997 |
| GB | 2323861 | A | 10/1998 |
| WO | WO2006083159 | A1 | 8/2006 |
| WO | WO2011025373 | A1 | 3/2011 |

* cited by examiner

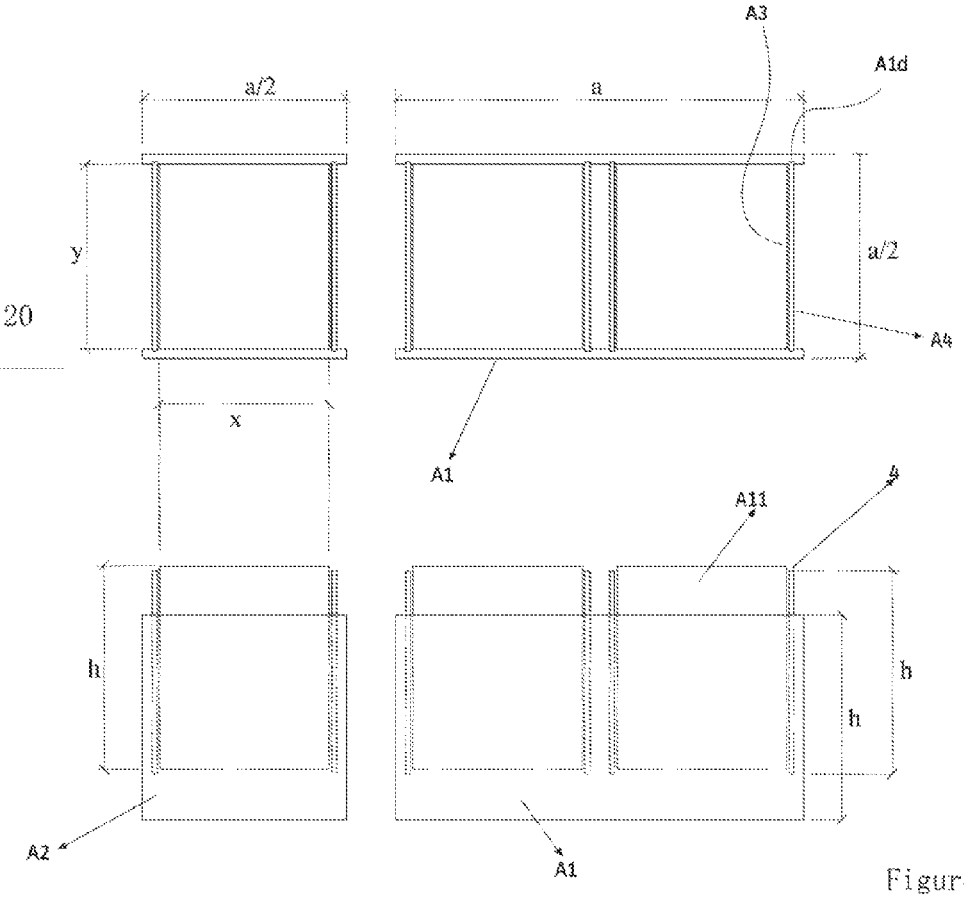
Figure 20
Figure 21
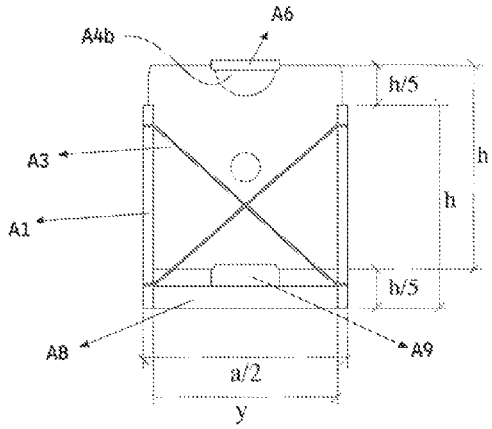
Figure 22
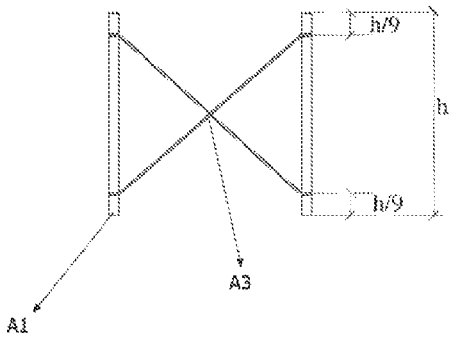
Figure 23

FOLDABLE BRICK WITH ROPE ATTACHMENTS AND DETACHABLE WALL BUILDING SYSTEM

TECHNICAL FIELD

The invention is about a modular foldable brick winch is only assembled with ropes that enables architectural elements such as stacked walls, arches, corners, doors, windows and wall niches to be constructed at indoor and outdoor conditions that divides, restricts and secures a certain space or area; storing and carrying this brick at a minimum weight, which is both connectable within itself and attachable for constructing architectural elements as a wall building system. This invention is about a stacked wall building system that is based on interlocking and fitting units and a brick unit having a height and volume reaching up to the arithmetical sum of the thickness of the material it is made of, that is self-folding which ensures a personal freedom for customizing the features of an architectural structure, having no size, volume, space and area restrictions, consisting of a single and completely detachable parts.

BACKGROUND OF THE INVENTION

The invention consists of a foldable brick, which has two large and one narrow chambers inside when the first brick unit is installed, that has been designed and manufactured with optimal lightweight materials, can be interlocked and can be fitted side by side and on top of each other and can be installed without requiring any tools and equipment; front and rear walls of the brick which have been attached with a high strength rope—the visible surfaces of these walls can be optionally coated—and interlocking elements that enables the assembly, fitting and interconnection of the bricks. The foldable brick, can be installed, removed, folded and re-installed over and over again numerous occasions without using and tools and equipment. Thanks to the rope attached internal connection structure, the volume of the chamber comprised inside the foldable brick unit disappears during storage and transportation. This system can be installed without requiring a special skill within, an overall architectural space, this allows individuals to remodel their own spaces, to reconstruct in a different shape and form or for a different function and make additions/extensions. As the same elements can be used again, materials as in conventional methods, do not become nibble and discarded.

Foldable brick, thanks to the improved rope connection system, is quite lightweight and flexible as it is made of very light material; can be folded or be stacked in many different ways. In the making of foldable brick, no connection elements such as metal or plastic-based screws, nails etc. are being used; therefore the materials and techniques used in the manufacturing of this unit are completely recyclable. Foldable brick, being an invention which is completely outside of the traditional approach regarding issues such as storage, storing, transportation, installation, cost, structure, sustainability, maintenance, resistance, hygene sanitary, environmentalism provides a solution that did not exist before.

The invention relates to a fitting locking system which is reciprocally located at least in two places on this foldable brick or in other words on these structure units to enable them to be connected in a way that ensures formal, functional and aesthetic integrity among brick units and to reduce these units to the area, height and volume of the material and/or materials that they are made of, through completely eliminating the area and volume that bricks, concrete blocks or units occupy in the universe along with the air gaps/chambers they contain, by folding in upon itself. This invention describes a general overview presentation of a series of interconnected units and at the same time describes a foldable brick connected with a high strength and completely flexible rope that forms the connection structure of this unit and the structure and fitting interlocking system that enables a three dimensional structure with volume to be reduced to a structure with the minimum size, thickness and volume possible by stacking upon each other and converting into a plate like flat shape that leaves absolutely no space between corresponding walls.

Such easy to assemble and disassemble panel systems with interconnected structures are available in the current techniques; there are different systems to be known as it can be seen in the following patent documents.

In the patent application no: EP0960585 (A2), a kit for the installation of three-dimensional structures is being described. Here, the cubic kit mentioned has connection elements formed with padding elements and intermediate plates. These padding cubes have sockets for connection elements on each corner and base surface along through all corner surfaces. Intermediate plates have locking gripping elements applied with positive force onto each surface, this way two cubes which is to be combined, can be locked to each other. This kit also has panels within the mentioned padding elements and/or grips which have been connected and organized with the same grid pattern like the connection sockets, which have been aligned with padding cubes.

On the other hand, patent application no: GB2323861 (A) is about a wall structure designed for display stands. The wall structure here contains removable panels, cross shaped parts, support legs which are interconnected in a way to correspond to the frame. Vertical legs have front and rear surfaces. Cross pieces are connected in a way to face the surfaces of the adjacent vertical legs along with the panels connected to the front surface. These vertical legs are comprised of a sheet material folded into a pipe shaped structure. Windows pairs are formed on front surfaces; the distance between adjacent windows pairs is equal to the distance desired between adjacent panels. Panels that are connected to the same pair of vertical legs having overlapping areas serve to limit the light leaking between two panels. There are hooks on the corners of these panels designed for the extensions on the windows and for casings. These panels are providing a removable wall system without disturbing other panels.

The patent application no: DE4208193 (A1) is about a demountable construction system designed for structures and items having panel corners shaped with profiled gripping stripes that construct supporting structures. This structure has panel corners inside these profiled units that take form by interlocking each other. Each structural element has two profiled corners that are at least connected to these panels. These inter-connectable profiles can be secured with inner springs or with a self-locking design. Hinge pins are located in the holes prepared inside the structure for doors and shutters. The purpose of this invention is to construct an item/furniture in a simple way without using separate independent connectors.

However, each of above mentioned systems and many other similar structures, items and furniture systems, offers different solutions in terms of functionality and structure to overcome one or several problems regarding the available technique, our invention is on the other hand has a different approach in comparison to the already known systems with its special dismountable foldable brick design.

SUMMARY OF THE INVENTION

The main purpose of this invention is to easily reduce/convert a 3 dimensional structure unit to a minimum thickness and volume thanks to its foldable connection design that has flexibility and mobility in a similar fashion to the ligaments holding the human knee joint together. As a result of this conversion, the construction unit only occupies an area equal to the volume of the material or materials that it is made of, without leaving any gaps in between. The previous size of a unit is decreased approximately by 5 times. This design not only ensures convenience and ease for transportation and storage but also savings in material and transportation costs, by offering a low cost, removable and foldable brick that can be installed over and over again.

Another essential purpose of the invention is to enable structures in any form and architectural form, to be built by entirely allowing personal customization freedom for any type of structure without any restrictions and boundaries thanks to the detachable design of the foldable brick.

One purpose of the invention is to enable a sub-structure system that can be easily implemented for different types of furniture or a construction system that forms a new partition/room as an alternative replacing use of plasterboard especially in spaces such as offices, houses as well as building structures such as panels, rooms, cabins, items, furniture etc., constructing architectural elements such as walls, arches, corners, doors, windows, niches etc. at indoor and outdoor conditions by stacking easily foldable modular units upon each other that have been designed with an fitting/interconnection/interlocking system. The aim is to offer a wall building system in which anyone can easily build his/her own space starting from the desired location, disassemble and make extensions without any skills and any re-construction works needed for constructing any customized partition/room with traditional bricks, briquettes or plasterboard. With the system described in the invention, it can be possible to construct customized partitions/rooms/spaces in any size, form/shape, pattern and color.

Another purpose of this invention is to materialize a brick as a unit of the wall building system which is easy to build up, offers effortless and minimum storage and transportation thanks to the mobile but strong internal structure (connection system) that occupies minimum volume without leaving any gaps after being easily, quickly and practically demounted. During the installation of the foldable brick, being the subject of the invention, it can be possible to easily install and also dismantle the units without using any tools or equipment such as screwdriver, hex key and similar other tools.

Foldable brick, is constructed by internally attaching a high strength rope like the ones used in tree houses in some of the primitive tribes of Amazons or like the ones used by ancient Egyptian wood makers —which may be a steel rope—through front and rear walls (just as in the cruciate ligaments of human knee joint) by making a simple sailor's knot similar like sewing them together. This mobile and flexible connection is designed to be folded by getting disassembled countless times and installed and mounted again. When folded, the air chamber inside completely disappears and the foldable brick is reduced to the total volume of the material or materials used for the manufacturing of the foldable brick.

One of the purposes of the foldable brick that has completely dismountable parts is to use corrugated board, which is a simple and cheap but green recyclable material for creating a solution to the sound isolation issue, which is one of the biggest problems of wall systems. Again, with this inner filling unit that is formed by folding in it upon itself in a completely unique fashion, it can be possible both to increase the durability and strength of the wall and to maintain acoustic comfort level by minimizing the sound permeability.

A foldable brick with rope attachments and detachable wall building system developed for the purpose of "folding itself", can be easily composed a rectangular structure with a three dimensional volume, inner cavernously by three different techniques based on the connecting/fixing principle of the front/back two opposite wall with rope and sash which constitutes the brick.

BRIEF DESCRIPTION OF THE DRAWINGS

Among these as seen in the FIGS. 1-23 (group A) and FIGS. 24-33 (group B), it is based on the connecting/fixing (straining, pulling) principle of the inner wall. Outer surrounding/encircling principle seen in FIGS. 34-38 (group C) is based on the (fixing with wrapping). All three techniques are related to the forming of the detachable wall building system's entity unit foldable and sustainable brick. All these three techniques can be both used as separately, or simultaneously according to the different client utility/profit expectations or different (mixed) material consumption.

The formation/combination and interlocking/interconnecting/fitting mechanisms for the foldable brick and wall building system, which have been designed to fulfill these purposes, are shown in the attached figures, these figures are;

FIG. 6A: Perspective view of the A-typed demountable foldable brick, which is the subject of this invention, showing the open phase of the corrugated board filling/padding box before it is folded in.

FIG. 6B: Perspective view of the A-typed demountable foldable brick, which is the subject of this invention, showing how the corrugated board filing/padding box is folded in.

FIG. 20: Bird view of the A-typed demountable foldable brick, which is the subject of this invention, showing a single and half brick unit while the tongues are locked.

FIG. 21: Front view of the A-typed demountable foldable brick, which is the subject of this invention, showing the mathematical construction ratios of a single and half brick unit while the tongues are locked and corrugated board brick is placed into the inner gaps.

FIG. 22: Side view of the A-typed demountable foldable brick, which is the subject of this invention, showing the mathematical construction ratios of a brick unit while the base unit (base+base beam clamp), tongue and upper beam is locked on each other.

FIG. 23: Side view of the A-typed demountable foldable brick, which is the subject of this invention, showing assembly ratios of the rope attachment that diagonally ties the front and rear walls of the brick unit to each other.

Figure 1:
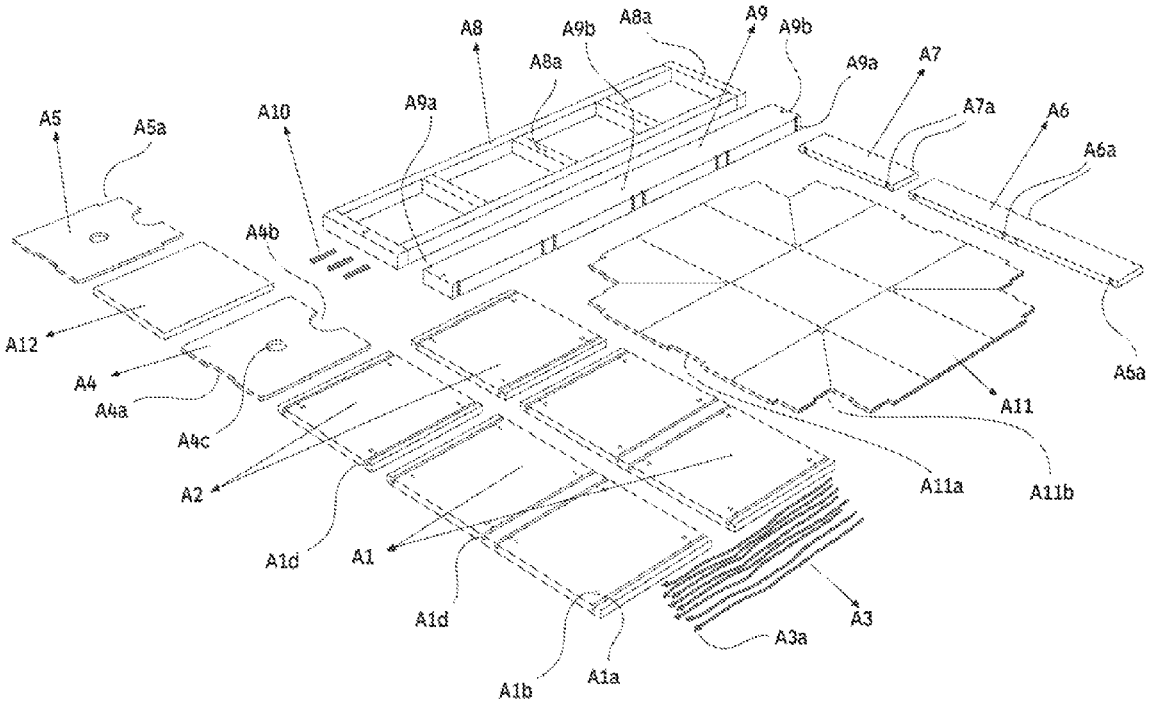
FIG. 1: Unassembled perspective view of the materials/parts that form A-typed demountable foldable brick and the wall building system which is the subject of this invention.
Figure 2A:
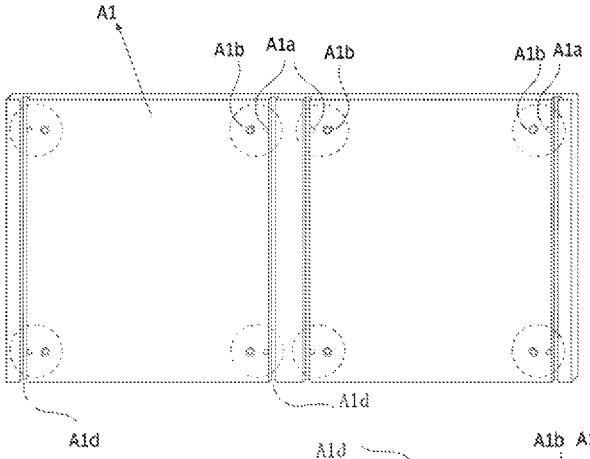
FIG. 2A: Interior surface view of any of the front and rear walls of the A-typed demountable foldable brick which is the subject of this invention.
Figure 2B:
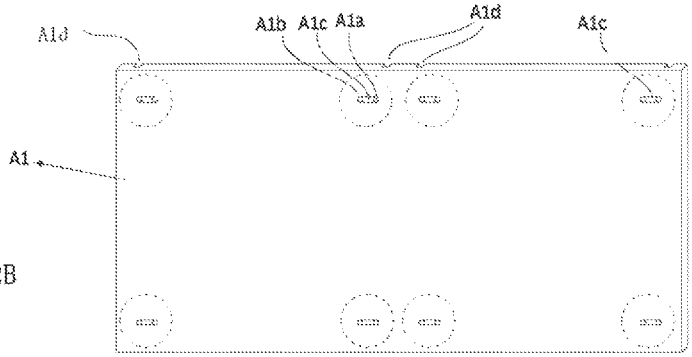
FIG. 2B: Exterior surface view of any of the front and rear walls of the A-typed demountable foldable brick which is the subject of this invention.
Figure 3A:
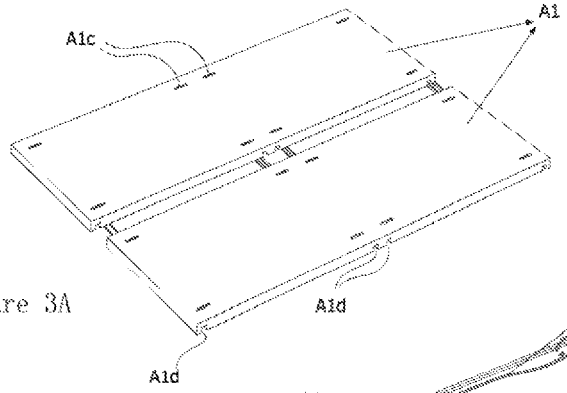
FIG. 3A: View of the A-typed demountable foldable brick which is the subject of this invention seen from exterior surface angle in a folded position when the ropes of the front and rear walls are attached (mounted).
Figure 3B:
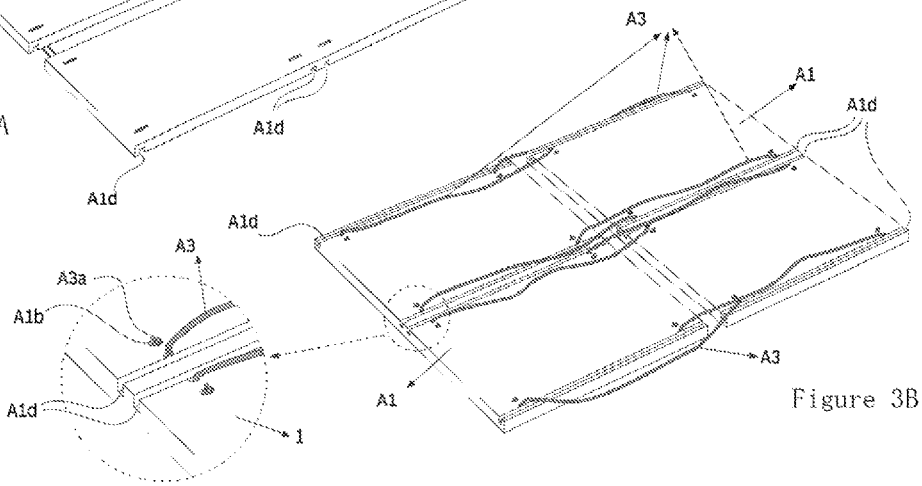
FIG. 3B: View of the A-typed demountable foldable brick, which is the subject of this invention seen from interior surface angle in a folded position when the ropes of the front and rear walls are attached (mounted).
Figure 4:
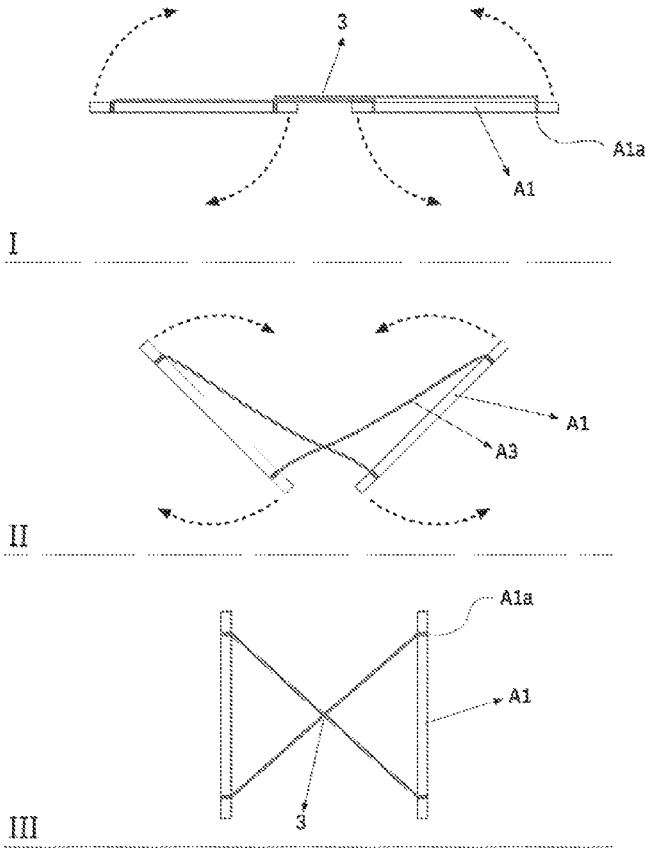
FIG. 4: View of the A-typed demountable foldable brick, which is the subject of this invention, seen from side angle showing how the brick becomes unfolded (II, III) while in folded position (I).
Figure 5:
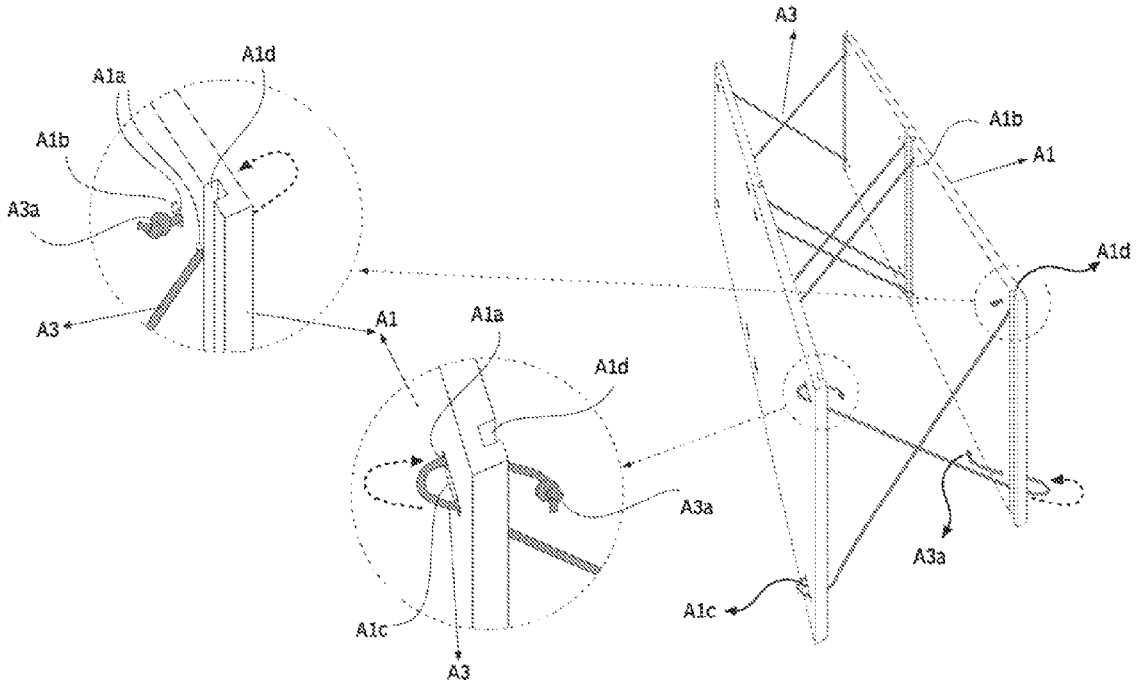
FIG. 5: Schematic view of the A-typed demountable foldable brick, which is the subject of this invention, showing how the rope making the mentioned attachment by going through the front and rear walls of the brick, like sewing them together/sewing a button; here it is highlighted how the ends of the ropes are prevented from coming out of the hole by making a simple sailor's knot shown from a perspective angle while the foldable brick is in unfolded position.

Separate numbers are given to each of the parts and technical details shown in the figures and the descriptions to these numbers are given below:

References in FIGS. 1-23 (Group A)

A—Brick body
A1*a*—Connection hole
A1*b*—Countersunk connection hole
A1*c*—Rope slot
A1*d*—Beam groove
A2—Half Brick Body
A3—High strength rope
A3*a*—Rope knot
A4—Tongue beam
A4*a*—Beam clamp insertion slot
A4*b*—Beam clamp insertion slot and wiring groove
A4*c*—Finger insertion hole
A5—Corner Tongue Beam
A5*a*—Brick body fitting slot
A6—Beam Clamp
A6*a*—Tongue beam clamping groove
A7—Half beam clamp
A7*a*—Tongue beam clamping groove
A8—Base
A8*a*—Dowel Joint Hole
A9—Base beam clamp
A9*a*—Tongue beam clamping groove
A9*b*—Dowel Joint Hole
A10—Dowel Joint
A11—Corrugated board padding box
A11*a*—Beam clamp fitting slot
A11*b*—Diagonal lock slot
A12—Cap References in FIGS. 24-33 (Group B)

B1—Brick Body
B1*a*—Beam Groove
B2—Pliable string rope
B2*a*—String rope connection end
B2*b*—Staple
B3—Insulation panel
B3*a*—String rope insertion hole
B4—Tongue beam
B4*a*—Beam insertion slot
B4*b*—Installment hole
B5—Beam clamp
B5*a*—Beam clamping groove References in FIGS. 34-38 (Group C)

C1—Brick Body
C1*a*—Beam Groove
C1*b*—Wire Frame Groove
C2—Wire Frame
C3—Tongue Beam
C3*a*—Beam insertion slot
C3*b*—Installment hole

DETAILED DESCRIPTION OF THE INVENTION

The flexible rope (A3) connection system used in the demountable foldable brick (FIGS. 4, 5, 28A, 28B, 28C), which is easy to manufacture, build/mount, remove/demount and to fold, can be made of flexible but strong materials with movement ability such as high strength parachute or harpoon rope or steel wire-type materials and pliable string, rope (B2) can be made of high resistant jacquard string rope or string bond that are made of high resistant materials, which are flexible but not stretch as plastic. Wire frame used in externally wire frame (C2) can be both irons or steel wires or wire ropes and it can be made from a high resistant normal rope or string rope whose two sides are merged.

Front and rear walls of foldable brick (Al, A2, B1, C1), removable tongue beam (A4, A5, B4, C3) and cap (A12), can be made from any type of durable material that is hard but not brittle including plastic, glass, metal, ceramic, clay and etc, such as solid wood, plywood, laminated chipboard, laminated MDF, hard and strong cardboard, acrylic, PVC foam sheet (DAKOTA FOREX). While the base (A8) can be made of materials such as solid wood, plywood, chipboard, MDF, beam clamp (A6, A7, B5) and base beam clamp (A9) can be made of plastic or metal alongside to those materials. Corrugated board padding box (A11) can be made of corrugated paperboard or also corrugated but plastic based sheets. Insulation plate (B3) can be made from any of these materials; paper box, fiber paper box, paperboard, ribbed cardboard or ribbed plastic plate, EVA, felt and plastic.

The front/rear body of the foldable brick (A1, A2, B1, C1) and tongue beam (A4, A5, B4, C3) can be manufactured in any size based on the need; the value of the lateral side of this surface material, that we call its short edge or its depth and its height should be 1 unit whilst its width should be 2 units (FIG. 20). In other words the short edge/depth and height to width ratio should be 1/2 (FIGS. 20, 21). However, based on this ratio, a cube shaped complementary half-brick (A2) can be also created by having 1 unit of depth and height value while having 1 unit of width value; besides by having 3 units and 4 units of width value similar to various wall stacking techniques/versions, it can be possible to divide an inner partition into two divisions/areas within itself by making a "T" connection at the place facing the interior of the divided space in a way that will answer various esthetic, structural and functional needs by changing the ratios. Moreover, with twenty four unit width applications, formations like lintel/beam are easily applied Furthermore, folding principle/feature, which this invention is based on, can be shaped according to the need when required; and different architectural structure units can be built such as arches, keystones, door window connection columns, alongside with circular and polygonal walls and also furniture items in many forms and shapes can be made. The thickness of the front and rear walls of the foldable brick is preferably between 6-20 mm.

On the top and bottom edges of the front and rear walls of the mentioned foldable brick (A1, A2) as shown almost in all figures, there are holes opened side by side, such as button holes, being total of 8 pairs on a single brick (A1), total of 4 pairs (A1*a*) on a half-brick (A2). High strength ropes (A3) passing through these holes allow the front and rear walls of the brick to be attached/mounted to each other. This way, as in the cruciate ligaments in the human knee joint, thanks to the pulling force applied inwardly the parts are prevented and to be stretched from falling apart outwardly. Thus, just, thanks to the inner direction of the applied pulling force is prevented from leaving towards the external side parts. One of those double connection holes (A1*a*) located on the inner wall surfaces of the brick, is a countersunk connection hole (A1*b*) and with a very simple sailor's knot, the rope is prevented from coming out of this hole. This countersunk hole, enables the rope knot (A3*a*) of this knotted end of the rope to be buried without any bulges on the surface. The depth of the slot (A1*c*) opened between these double holes on the exterior surface of the brick is equal to the thickness of the rope that enables this connection. As shown in all figures, the rope (A3) buried inside this rope slot (1*c*) is bare and visible from the exterior surface of the brick, like the string on a jacket or shirt button. Besides it allows all types of coating materials, which will be applied onto the exterior surface of the brick to offer aesthetic benefits, to be easily applied/coated.

On the interior surfaces of front and rear wall of the foldable brick body (A1, A2, B1, C1) that are facing each other, that are reciprocal beam grooves (A1*d*, B1*a*, C1*a*) located lengthwise being one on right and left and two in the middle. These grooves allow the tongue beam (A4, B4, C3), which enables the rope (A3) and string rope connection (B2) and externally encircled wire frame (C2) preventing the inward motion of the front and rear wall of the brick body (A1, A2, B1, C1) that is attached together with the mentioned rope connection, by applying force against the force coining from outward direction, to be tightened/fixing/stabilizing exactly until the desired brick depth (FIG. 22) and which immobilizes/stabilizes the forward-backward and upward-downward axial movements at that point, to be locked. This way, in the simplest form, a brick unit (B, C) is formed with the pulling and pushing forces balancing each other.

In this direction, the plate thickness of the tongue beam (A4, B4, C3) is enough to be fitted/placed inside the beam clamp insertion slots (A1*d*, B1*a*, C1*a*) on the front and rear wall of the brick, therefore there is no need to open additional grooves. Beam clamp insertion slot (A4*a*, B4*a*, C3*a* located on the bottom edge of tongue beam (A4, B4, C3) and beam clamp insertion slot and wiring groove (A4*b*) located on the upper edge of the tongue beam (A4, B4, C3) enable the beam clamp (A6, B5) to be locked in (FIGS. 10, ii and FIGS. 32, 33) for both mitering the foldable brick and stabilizing/immobilize the last and third axis (sliding/flexing movement to right-left). Beam clamp insertion slot and wiring groove (A4*b*) and installment hole (B4*b*, C3*b*) is in the form of a wide circular gap (FIG. 22 and FIG. 33, FIG. 38) which enables wiring and/or piping through cable trays or channels.

The third function of the tongue beam (A4, B4, C3) can be described as this, while the bricks are being stacked upon each other in the wall building system, the beam grooves (A1*d*) located on the interior surfaces of the front and rear brick bodies (A1, A2, B1, C1) that are aligned/lined with each other on the top and bottom, thrill a groove tray line by overlapping upon each other lengthwise from top to bottom through the foldable brick stack. This way foldable bricks are locked onto each other at the bottom and end by sliding these tongues vertically within this formed line. In this way, each upper brick, combined with two adjacent bottom bricks, lock/connect the entire system one by one without requiring any binding, connector agents such as mortar, adherents, screws or nails etc. for wall building system. The circular hole (A4*c*) located in the center of these tongues enables the user/builder to insert his/her finger and easily grab the tongues especially during mounting/demounting process.

Figure 24:
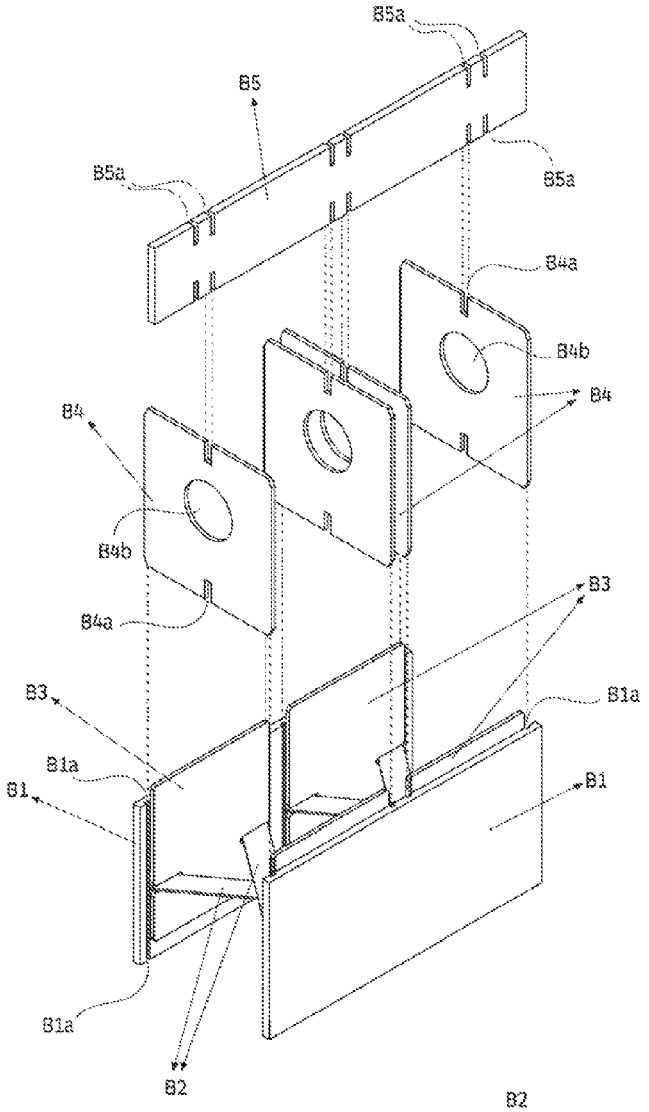
FIG. 24: It is the disassembled perspective view of the invention subject detachable B-typed foldable brick and wall building system and base materials/parts that constitutes it.
Figure 32:
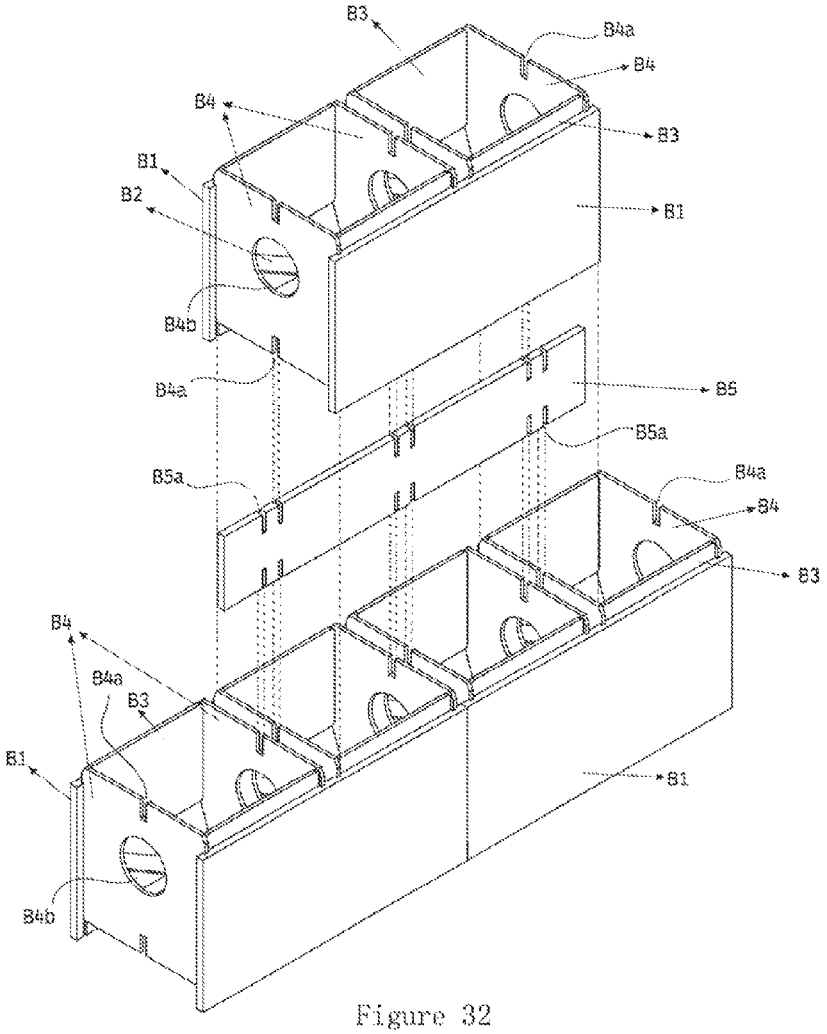
FIG. 32: It shows the perspective view of the invention subject of the detachable B-typed foldable brick, beam clamp and foldable brick units's binary and triplet interlocked flow.

As mentioned above and demonstrated schematically in FIGS. 10, 11, 32 and 33 beam clamp (A6, B5), which is one of the most critical parts of the foldable brick and demountable wall building system, solves the mitering problem, which is one of the most important problems regarding any type of wall building system including traditional wall building systems, by stabilizing and fixing the flexing/sliding movement to the right and left directions on the third axis of the foldable brick and enables the brick placed on its left and right to be locked in (FIGS. 12, 13, 32, 33) through the tongue unit (A4, B4, C3) located on the outer edge and middle line of the mentioned foldable brick. In this merging/clamping, beam clamp is used addition to the previous technique is cycled ninety degrees and perpendicular to the beam tongue (B4, C3). (FIGS. 24, 32). Beam clamp (A6, B5) makes this function with the tongue beams (A4, B4) belong to the brick units that is bottom of its bottom surface and on the upper surface, it makes this function with the tongue beams (A4, B4) belong to the upper foldable brick units (B, C) that are accumulated/placed on it.

In other words, the bottom half of the beam clamp locks the bottom bricks, the upper half of the beam clamp locks the top bricks to each other on tongue beams. In this way the beam clamp greatly increases the durability and strength exponent-static property-of the system, which is built by going across the each row of the foldable brick and wall building system lengthwise, vertical to the foldable brick bodies (A1, A2, B1, C1) to the brick body (1, 2) on a horizontal plane (FIGS. 14, 15 and 32, 33). Again, this locking principle completely solves the workmanship problems, such as grouting and misalignment which are among the biggest problems of traditional wall building system. The ultimate result, is a near perfect wall building workmanship.

Figure 6A:
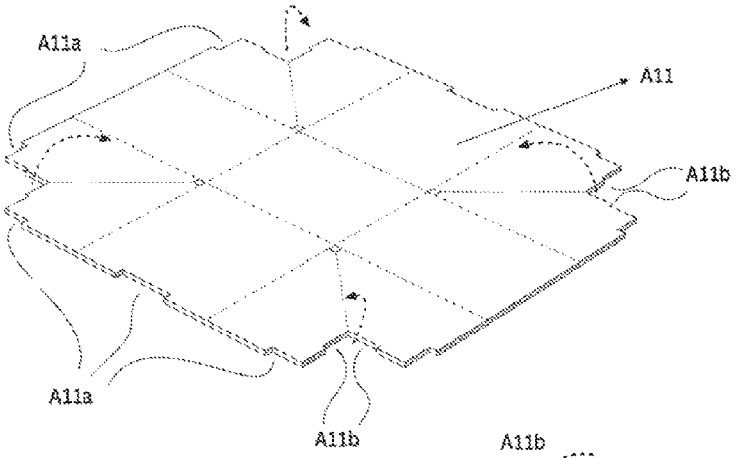
Figure 6B:
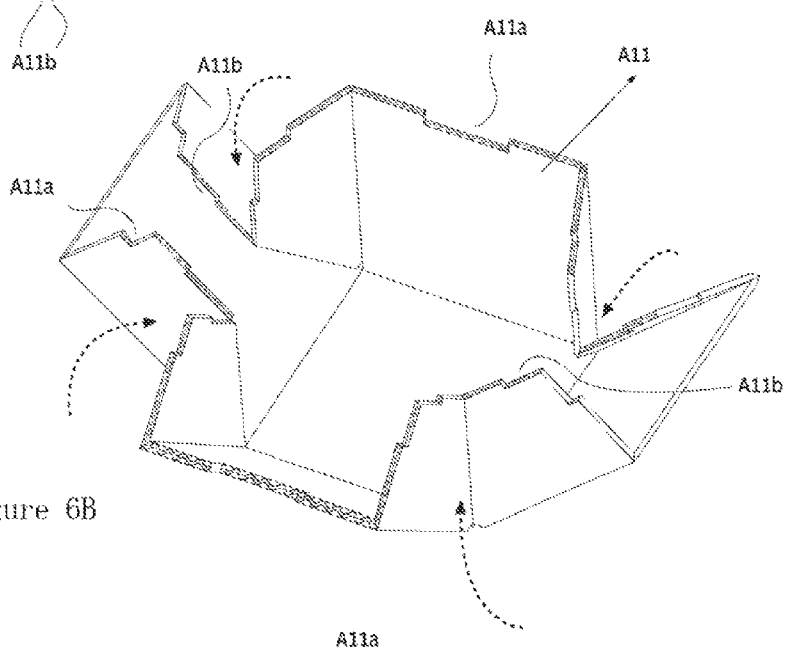
Figure 6C:
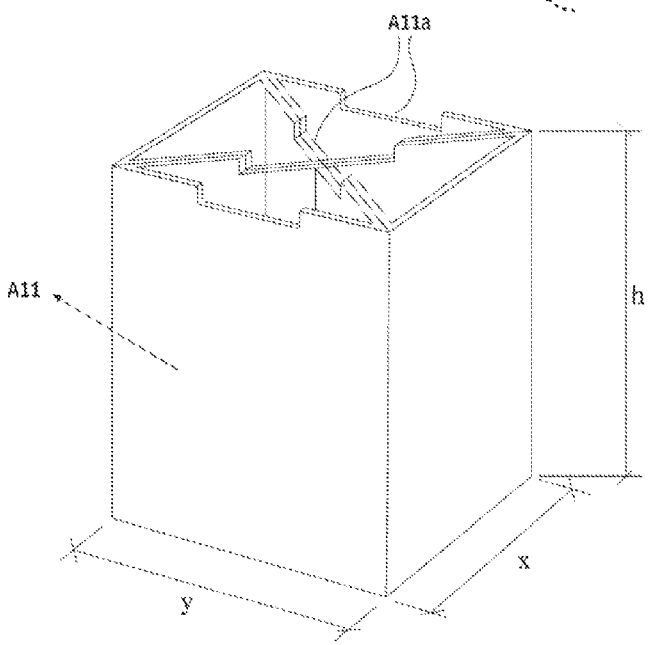
FIG. 6C: Perspective view of the A-typed demountable foldable brick, which is the subject of this invention, showing the corrugated board filling/padding box after it is folded in and ready for installation.
Figure 9:
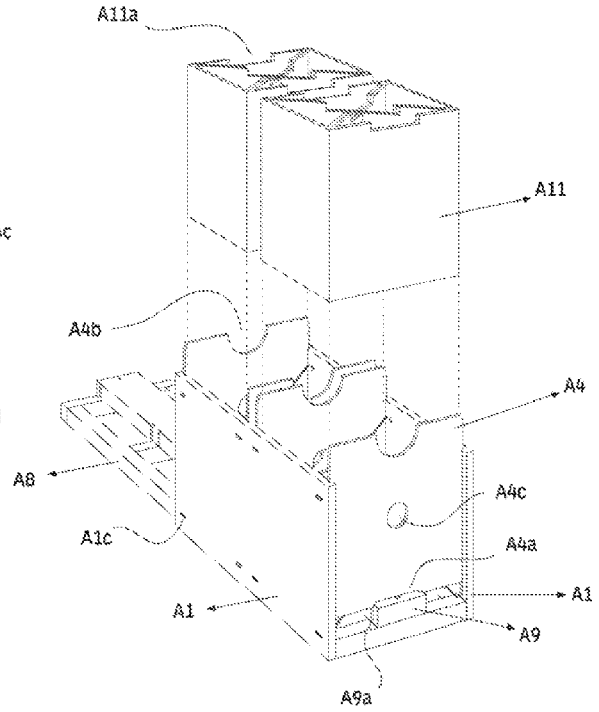
FIG. 9: Perspective view of the A-typed demountable foldable brick, which is the subject of this invention, showing how the corrugated board filling box is placed upon the inner chambers (air gaps) formed inside the brick after it is built up by locking with the tongues.
Figure 10:
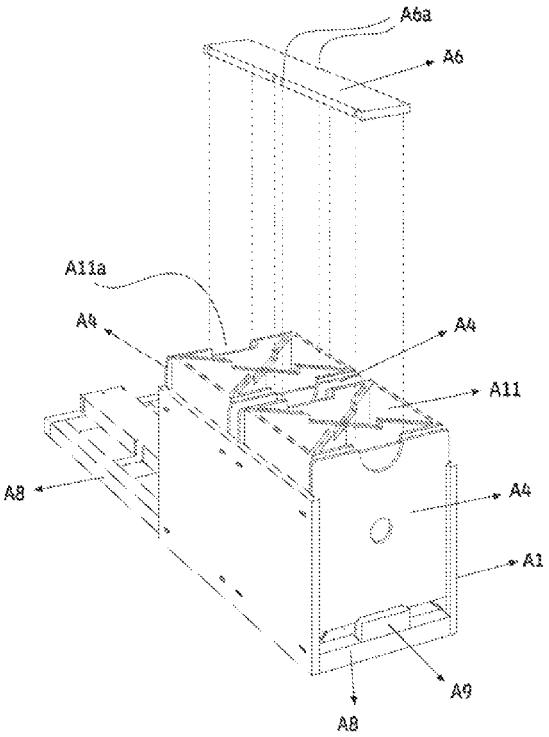
FIG. 10: Perspective view of the A-typed demountable foldable brick, which is the subject of this invention, showing how the beam clamp is being placed upon the connection/locking spot while the corrugated board filling boxes being in a fixed position in their places with their tongues being locked.
Figure 11:
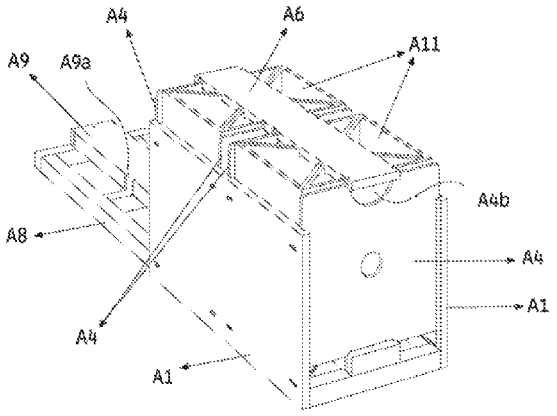
FIG. 11: Perspective view of the A-typed demountable foldable brick, which is the subject of this invention, showing while the beam clamp is placed upon the connection/locking spot and the corrugated board filling boxes are fixed in their places with their tongues being locked.

Another component of this invention is the padding box (A11), which offers huge benefits but is not necessarily requisite item; that is made of corrugated cardboard or corrugated plastic sheets and built with an entirely unique folding method. This padding box, as seen in FIGS. 6A, 6B and 6C, is built by bending, twisting and folding the conic sections according to the guiding lines to inward-upward directions form the corners of the box towards the center of the box. This box which is formed this way, has four walls that are progressing to the center from the corners and inter-locking with each other diagonally unlike having four sides and one bottom surface. (FIG. 6A) The ceiling/upper surface of this corrugated padding box is open and has beam clamp fitting slots (A11*a*) deep enough to allow the beam clamp to fit. The corrugated padding box (A11), as seen in the FIGS. 9 and 10, is fitted/placed into the chambers formed inside after the foldable brick body (A1) and tongue beams (A4) are locked together. While helping to maintain an acoustic comfort level by providing sound control, at the same time this padding box, strengthens the system both against forces may be applied from front and behind and weight may be applied in downward direction. At the same time, it reduces the fragility of the wall system during ground movements such as an earthquake while increasing the flexibility.

Figure 7:
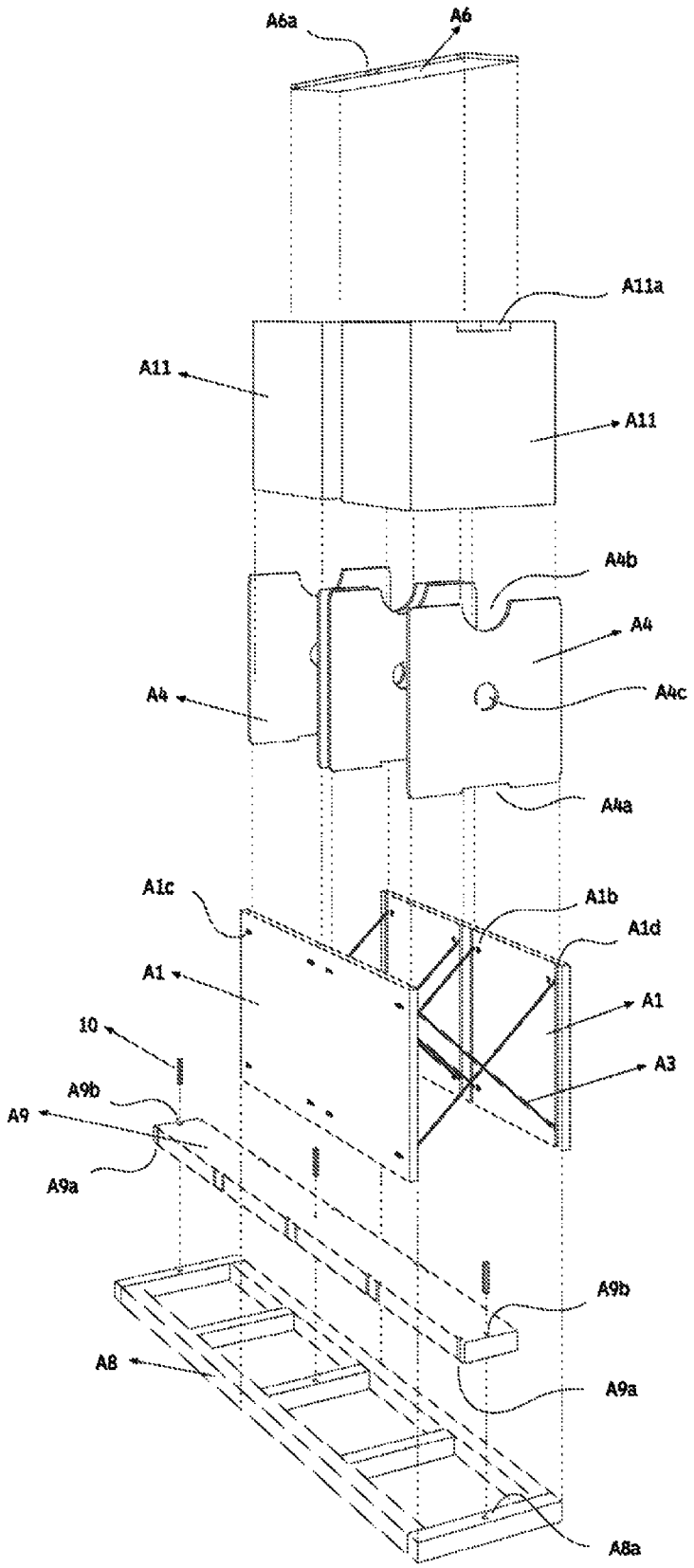
FIG. 7: Schematic view showing the phases/stages of the basic formation/interlocking principle and the perspective view of the entire parts of the A-typed demountable foldable brick and the wall building system, which is the subject of the invention, that are ready for installation.
Figure 8:
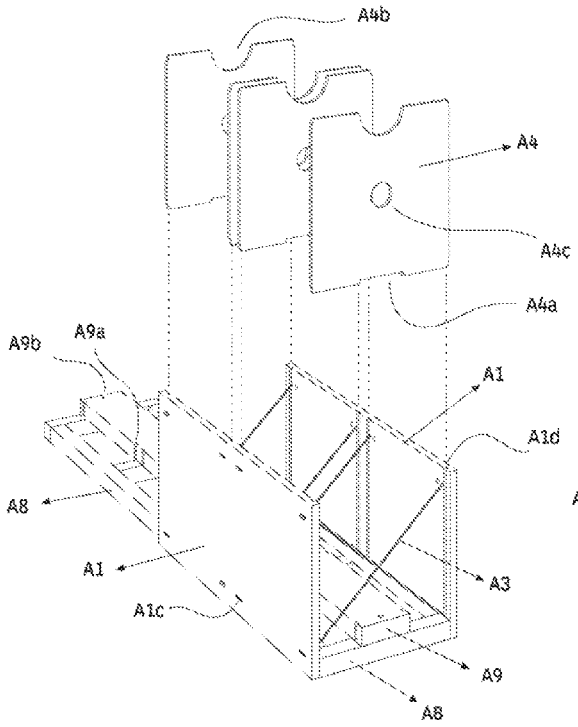
FIG. 8: Perspective view of the A-typed demountable foldable brick, which is the subject of this invention, showing the brick in an unfolded position (ailer the front and rear walls are separated from each other) while placed upon the base unit (base is the unit which is formed by placing a beam clamp upon the relevant spot on the base through dowels and showing the tongues while they are being vertically inserted in the dowel grooves located inside the brick's interior surfaces.

The folding principle of the foldable brick is as this;

As shown in FIG. 7, mounting/installation process and principle of the system is based on working from bottom to upward direction, whereas demounting/uninstallation process and principle is based on working from top to downward direction.

Dowel joint (A10) and base beam clamp is locked with each other through the corresponding holes (A8*a*) located on the base (A8) placed onto the ground. (FIG. 7) Afterwards, as in the train wheels locking with the rails on a railway from inner side, the brick body (A1), consisting of front and rear walls that are attached to each other with a rope, becomes ready for mounting by simply keeping these walls apart from each other. While stretching the rope connection this brick body (A1) is fitted/placed on this base unit (8+9) towards the outer edges of the base. (FIG. 8) in this layout position, without requiring any additional guiding equipment, tongue beam (A4) are vertically slid inside the beam grooves (A1*d*) located on the interior surfaces of the brick body (A1, A2) which is already stretched from the bottom edges by the base unit (A8, A9) and the beam clamp insertion slot (A4*a*) located on the bottom edges of these corresponding tongues, is fitted into the tongue beam clamping slot (A9*a*) located on the outer edges of the base beam clamp (A9), this way, the foldable brick is aligned and locked with the base unit (A8+A9). (FIGS. 8, 9) If the architectural structure is planned to be built in a more permanent fashion or if desired; a padding box made of corrugated board folded into a cube shape, can be vertically fitted/placed into the front-rear walls of the brick body and the chambers formed inside the brick surrounded by tongue beams, (FIGS. 9, 10). In order to demonstrate the mentioned invention, its main parts and installation details in a clearer way, this padding box (A11) made of corrugated board is intentionally not included in the figures other than FIGS. 7, 9, 10 and 11.

The main approach at the principle of interior stretched folding (Group B figures) is both simplifying the production and simplifying the folding procedures thus increasing users friendly property. In this process, pliable string rope (B2) is mounted by a mean such as staple or screw to the internal surface of brick body. (FIG. 27) Pliable string rope (B2) is connected crossingly at the internal surface of brick body (B1) that is separated two equal areas by the beam grooves at the middle line, on the single connection line from middle line to external side, from external side to middle line. This connection technique has two advantages: First, it is sufficient total 8 connection points on the single connection line instead connecting interrelated total 16 points such as previous crosslinking technique.

Figure 25:
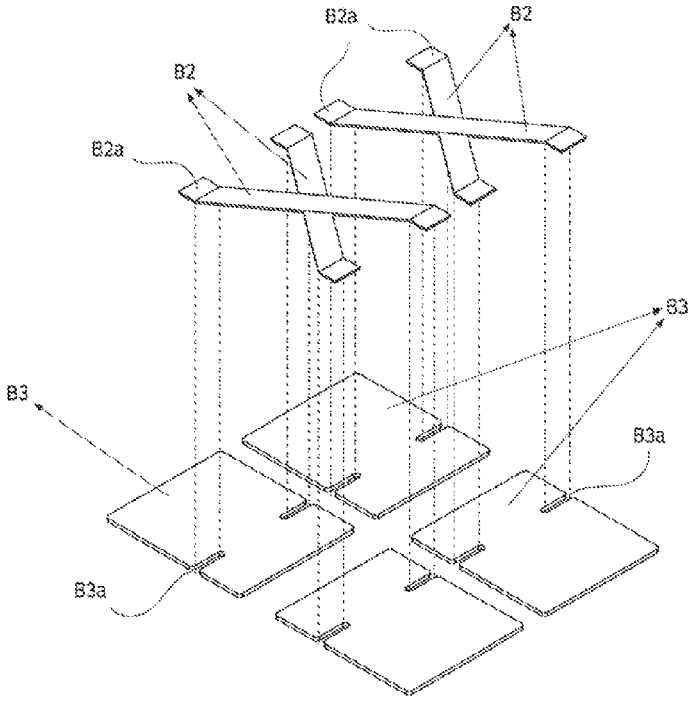
FIG. 25: It is the perspective view of the invention subject detachable B-typed foldable brick's front and back walls its insulation supported string-rope rack (link) that shows the construction of the mechanism.
Figure 26:
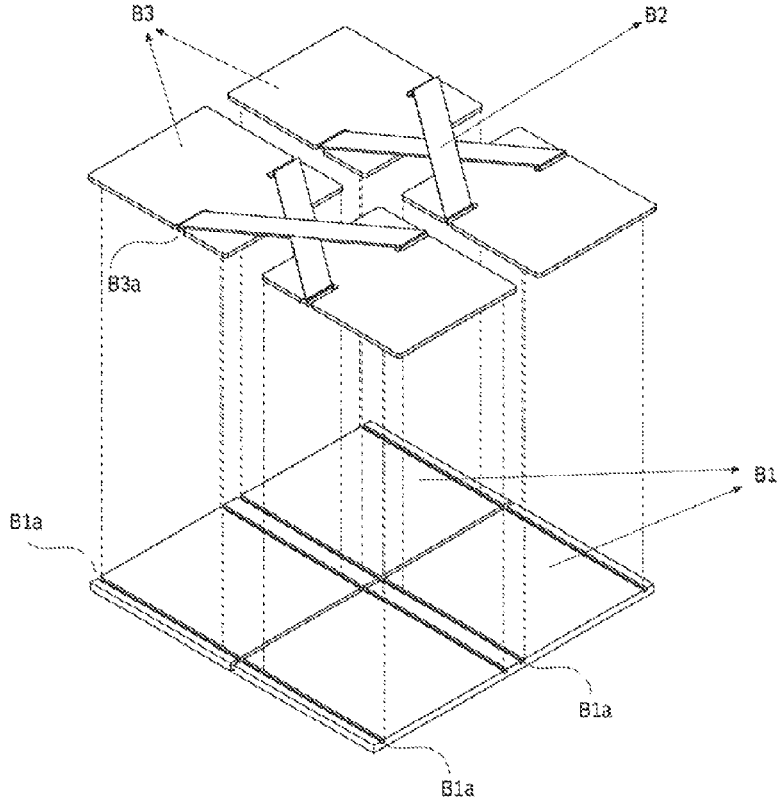
FIG. 26: It is the perspective view of the invention subject of the detachable B-typed foldable brick, insulation supported string-rope rack (link) mechanism's front and back walls of the brick and placing of it before montage.
Figure 27:
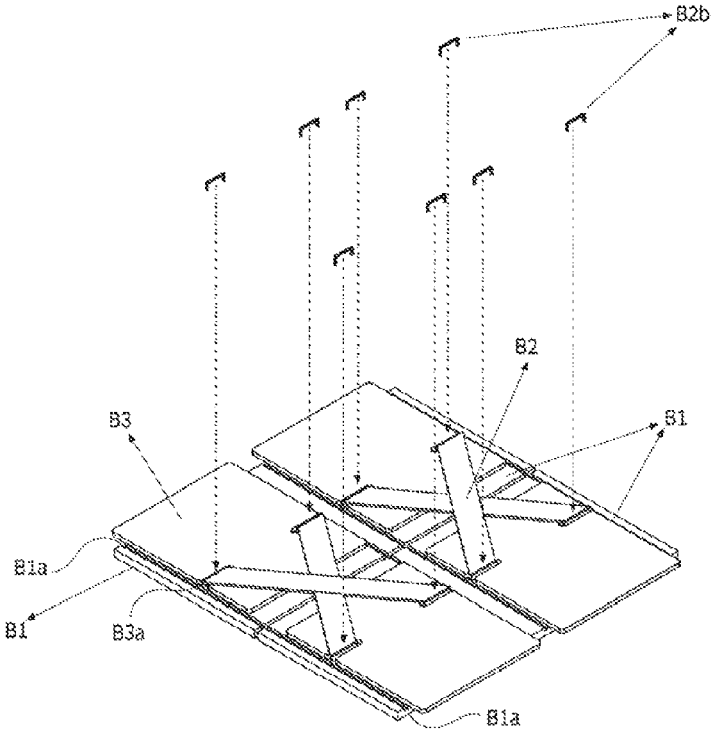
FIG. 27: It is the perspective view of the invention subject of detachable B-typed foldable brick, insulation supported string-rope rack(link) mechanism's fastening with a staple to the front and back walls of the brick.
Figure 28A:
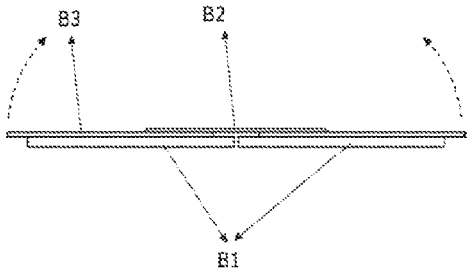
FIG. 28A, 28B, 28C show the complete side view of the invention subject of the detachable B-typed foldable brick, its opening when in the form of detached (the first stage of the brick setup).
Figure 29A:
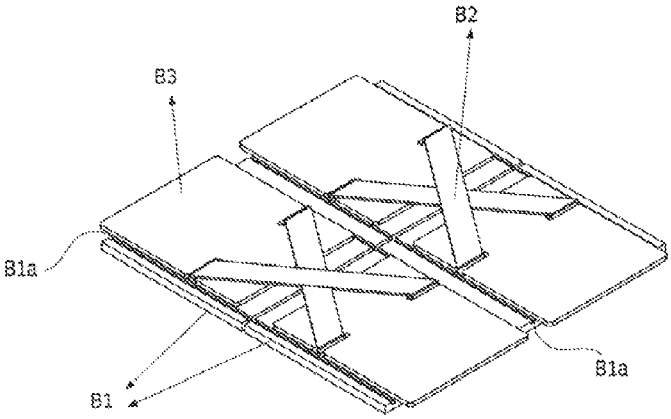
FIG. 29A, 29B, 29C show the perspective view of the invention subject of the detachable B-typed foldable brick, opening of it when in the form of folded (the first stage of the brick setup).
Figure 28B:
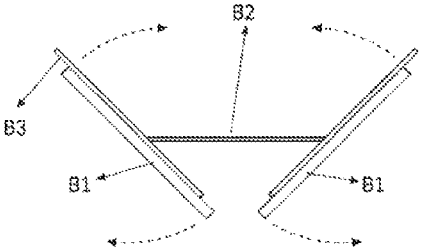
Figure 29B:
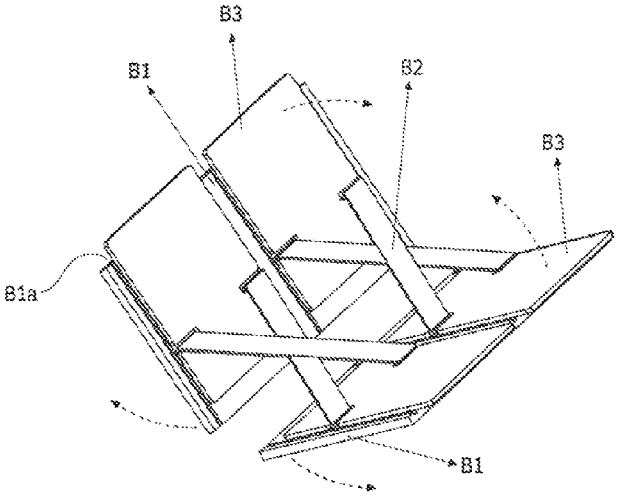
Figure 28C:
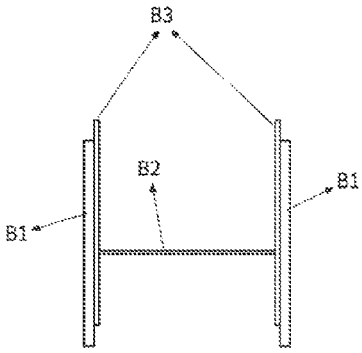
Figure 29C:
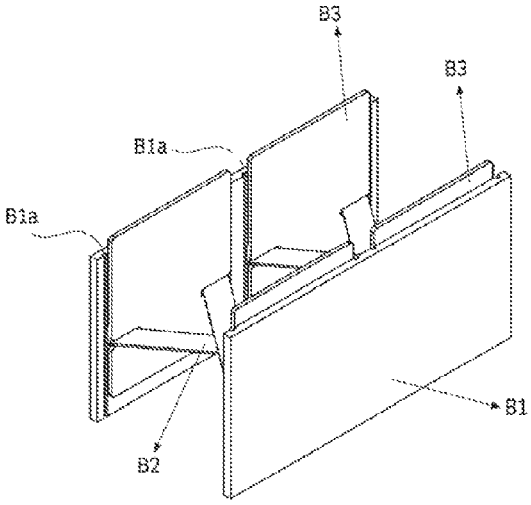
Figure 30:
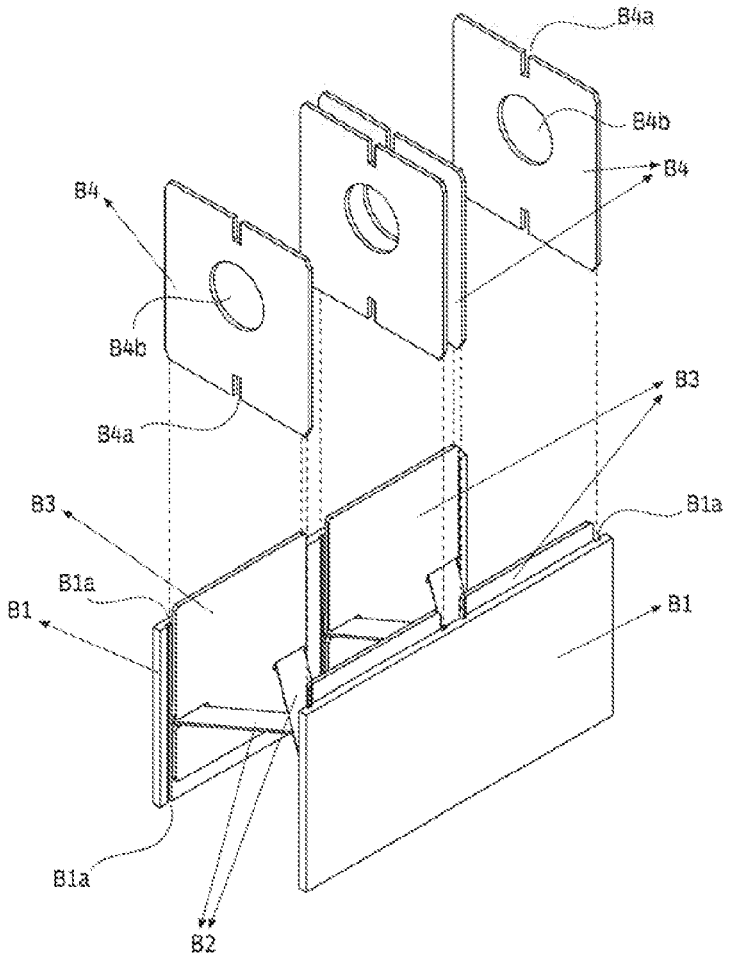
FIG. 30: It shows the perspective view of the invention subject of the detachable B-typed foldable brick, tongue beams' interlocking flow to the beam groove of the brick inner surface.

Second, the angulation problem of unit brick unit is solved by this crosslinking technique without beam clamp (B5). The crosslinking technique, for example, is ensured benefits to the fair users for setup time. Because, if requested, beam clamp (B5) is not used as shown FIGS. 32 and 33, having an advantage on time and cost. Before mounting the pliable string rope (B2) to the brick body (B1), after string rope connection end (B2*a*) inserted to string rope insertion hole (B3*a*) at the external side of insulation panel (B3), sticking by curling to the bottom surface of the insulation panel. FIGS. 25 and 26.

Figure 31:
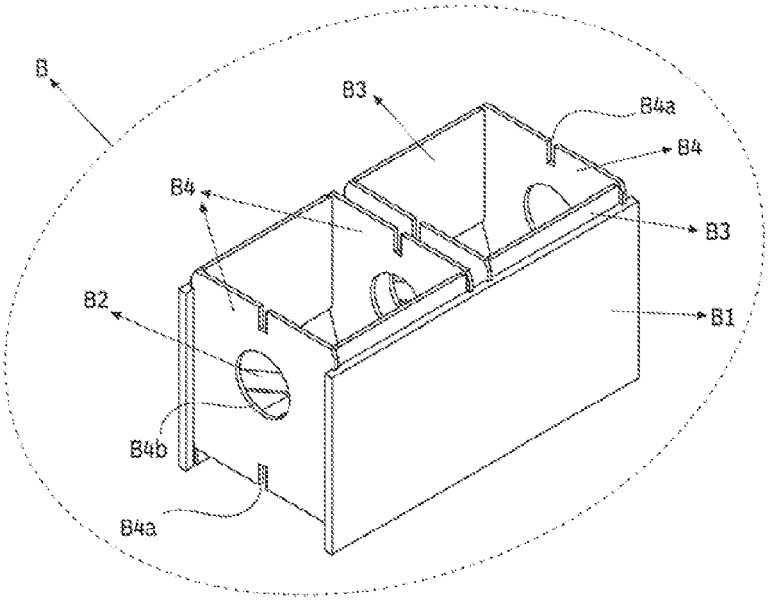
FIG. 31: It shows the ultimate version of the perspective of the invention subject of the detachable B-typed foldable brick's, wall building system's unit that are ready for foldable brick setup.

Insulation panel (B3) a string rope connection kit totally is placing at the related places on the internal surfaces of the brick body (B1) and they are fixed from the gaps at the string rope insertion hole (B3*a*) (that is reference point at the same time) by staple or screw. The function of insulation panel (B3) prevents light leakage at the connection point of overlapping sides of brick body during the connection, providing directly both sound and heat insulation without using any supporting material, according to kind of material used on the expectations of the user. After mounting the pliable string rope mechanism (B2) with insulation panel, the unit brick unit is ready to set up and as shown in FIGS. 28A, 28B, 28C, 29A, 29B and 29C, the folded brick body (B1) at the horizontal axis is hole from right and left sides and is lifted by turning upward. Tongue beams (B4) are placed by sliding in vertical direction to the beam grooves (B1*a*) in the internal surfaces of brick bodies (B1) which is lifted/set up vertical to floor. Thus, the foldable brick (B) that is the unit of the building wall system is obtained. (FIG. 31)

Figure 12:
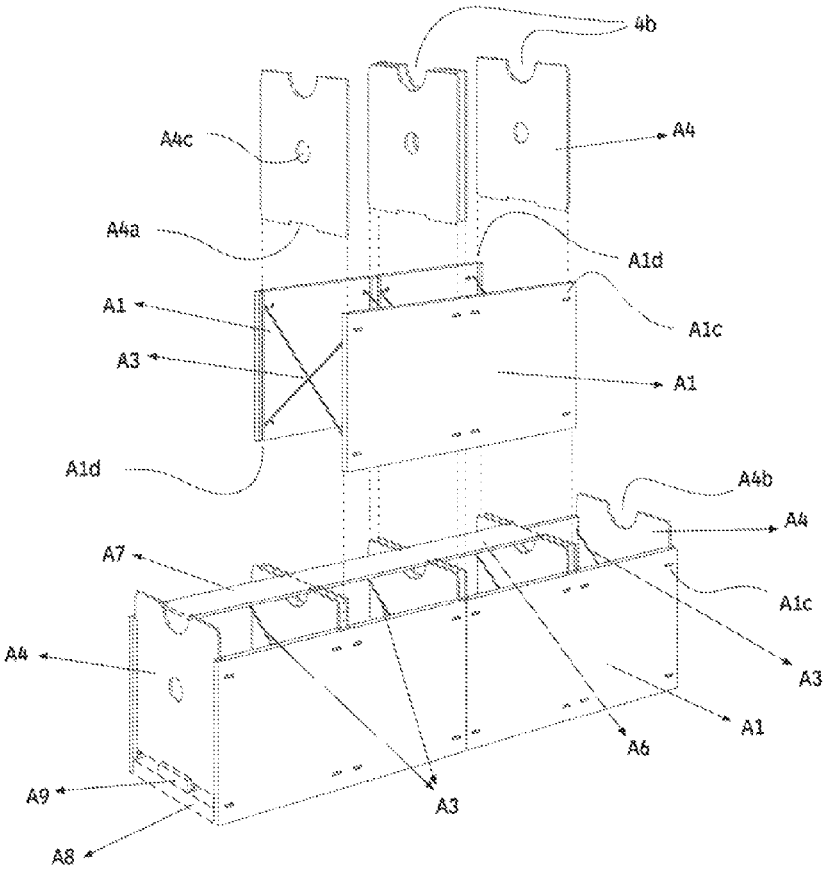
FIG. 12: Perspective view of the A-typed demountable foldable brick, which is the subject of this invention, showing how two horizontal bricks are laterally locked through beam clamps and how a third brick unit is vertically stacked/placed upon these two bottom bricks that are locked together through a beam clamp in an unaligned fashion.
Figure 13:
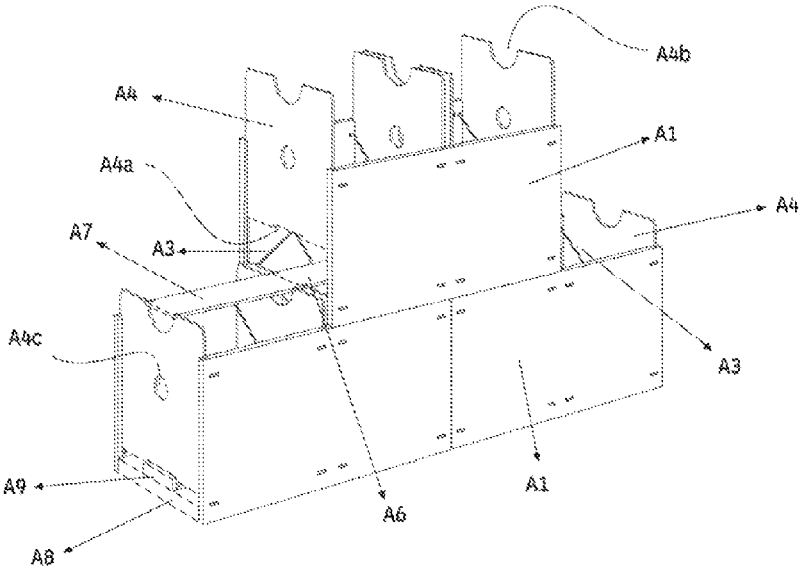
FIG. 13: Perspective view of the A-typed demountable foldable brick, which is the subject of this invention, showing the most basic triple interlocking mechanism of the mentioned wall building system and the foldable brick units that are clamped together through beam clamps and tongues.
Figure 14:
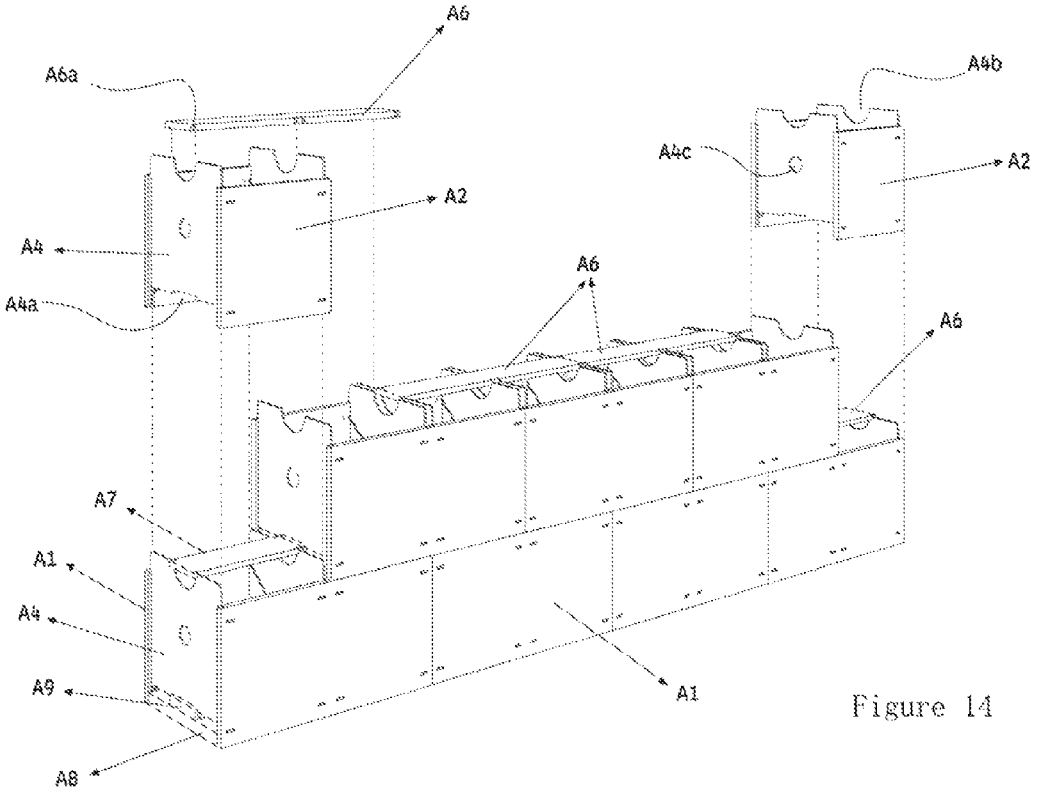
FIG. 14: Perspective view of the A-typed demountable foldable brick—A type—and the wall building system, which is the subject of this invention, showing how half brick units, which form the edge borders of the relevant brick row, are stacked or placed in their relevant spots.
Figure 15:
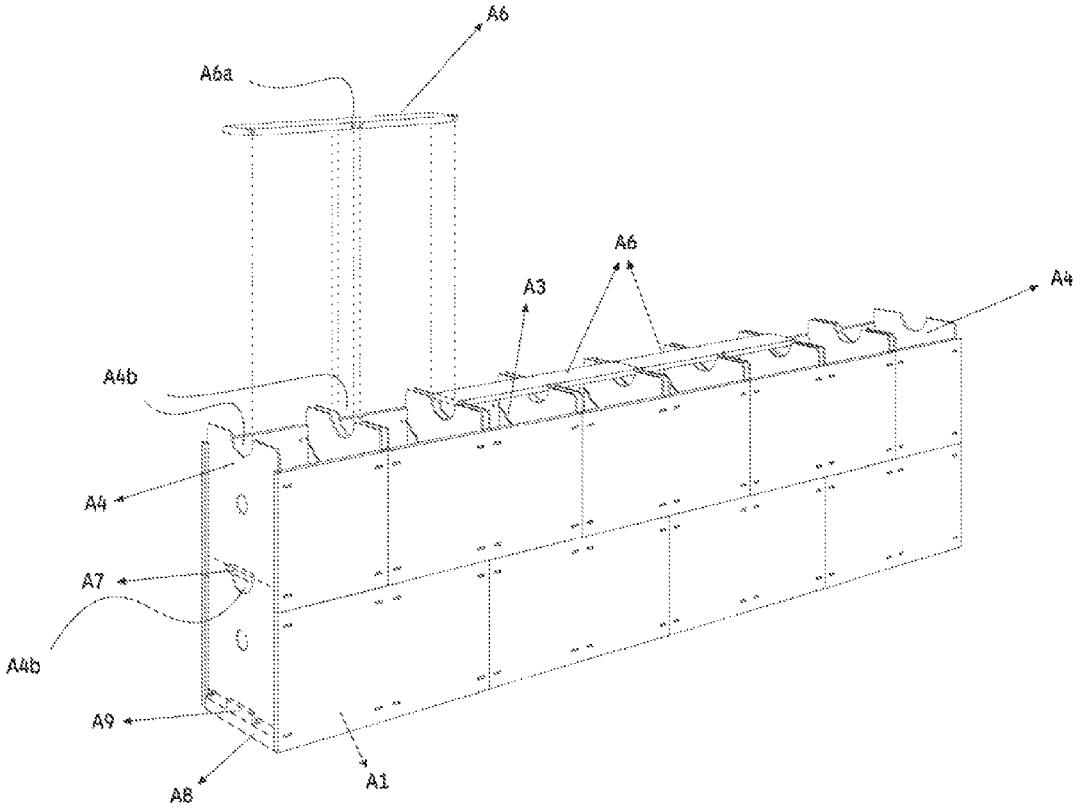
FIG. 15: Perspective view of the A-typed demountable foldable brick and the wall building system, which is the subject of this invention, showing how the beam clamps, which are used for locking units in each vertical brick row, are placed upon the grooves located on the tongues.
Figure 33:
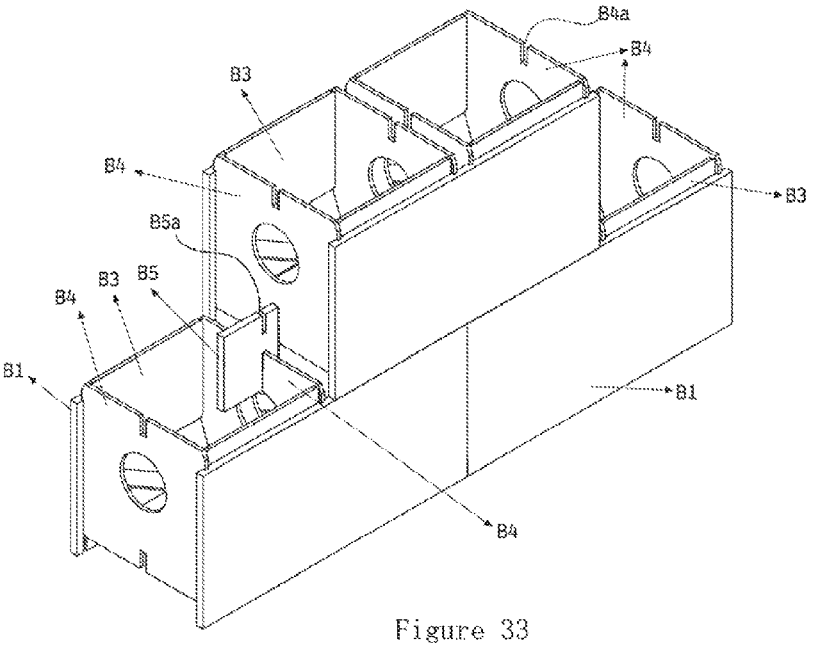
FIG. 33: It shows the perspective view of the invention subject of the detachable B-typed foldable brick, foldable brick units' triplet interlocking (first step of building/accumulation systems).
Figure 34:
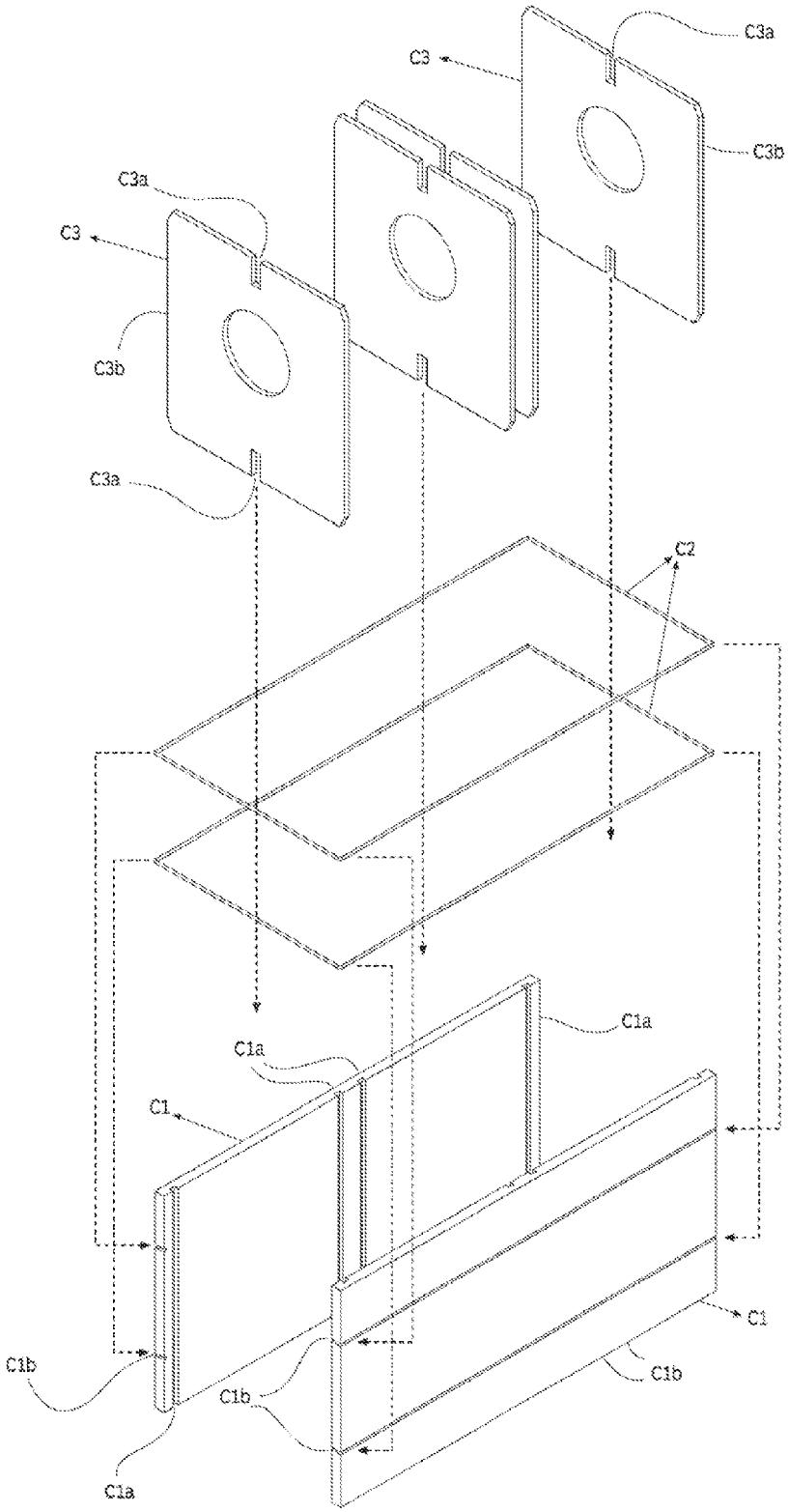
FIG. 34: It shows the perspective view of the invention subject of the detachable C-typed foldable brick, when externally encircled technique's basic materials parts are disassembled, wire/rope frames' wearing on the trunk of the bricks and montage flow of tongue beams.
Figure 35:
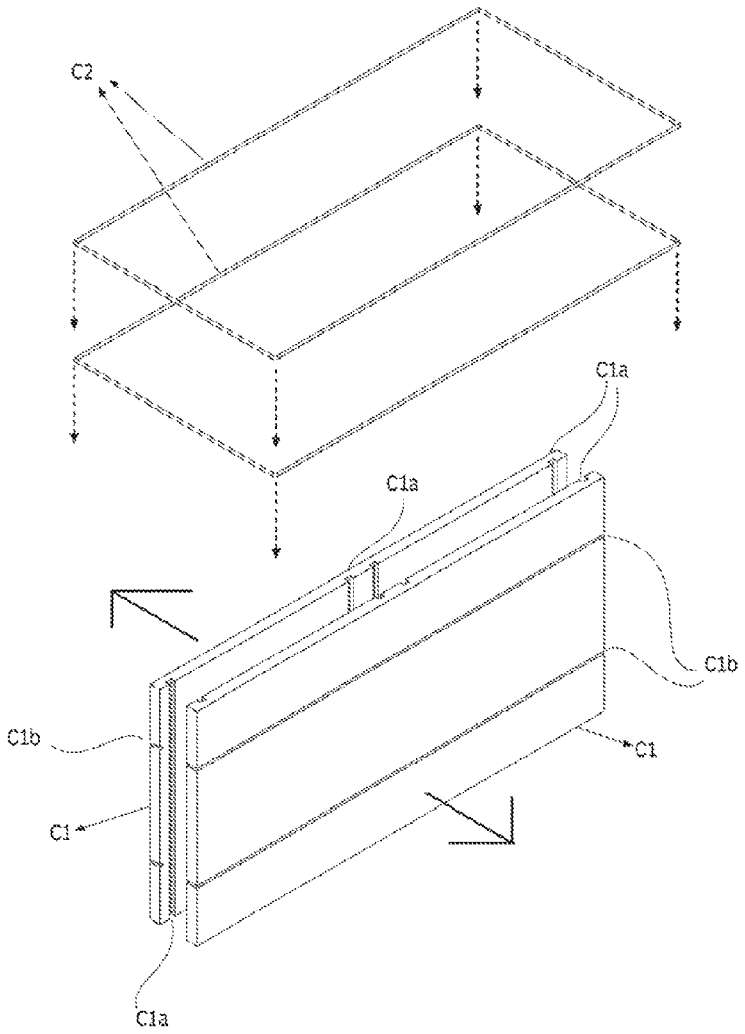
FIG. 35: It shows flowchart of the perspective view of the invention subject of the detachable C-typed foldable hick, which provides the externally encircling the wire/rope frame front back brick trunks.

The same steps are followed for the second unit to be placed on the right or on the left side of it. Onto those two foldable brick units placed adjacently on both sides, the beam clamp (A6, B6) is locked/connected by fitting the corresponding tongue beams (A4, B4) vertically into the beam clamp insertion slot (A4*b*, B4*b*), which is located on the upper edge, by passing through the center lines of both of these two brick bodies (A1, B1), while one being the starting point, other being the ending point (if the brick on the side is a half brick then from the outer line) (FIGS. 12, 14, 15 and FIGS. 32, 33). The foldable brick unit that is stacked namely is placed on the bottom row is seated/interlocked as shown in FIGS. 12 and 33 following the same way of the installation of the beam clamp (A6, B5). This fitting-interlocking is a couple fitting-interlocking. After first conjunction, the foldable brick unit (B) placed on the beam clamping groove (A6*a*, B5*a*), compressing in vertically, is seated on the tongue beams (A4. B4) forming male bulges of foldable couple brick unit is below it. In this way, the second fitting-interlocking is provided. (FIGS. 14, 15, and 33)

Figure 16:
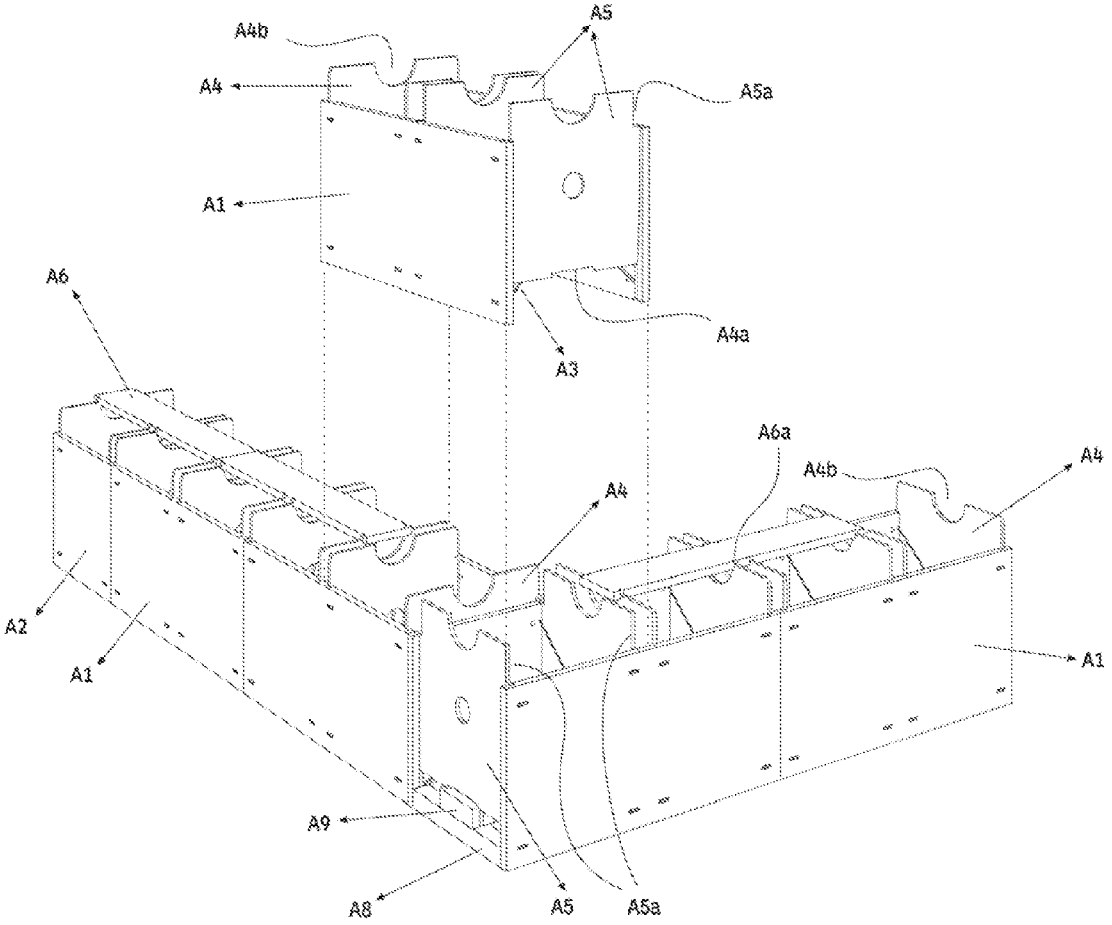
FIG. 16: Perspective view of the A-typed demountable foldable brick and the wall building system, which is the subject of this invention, showing how the corner tongue and the wall corner formation are locked to each other from top.
Figure 17:
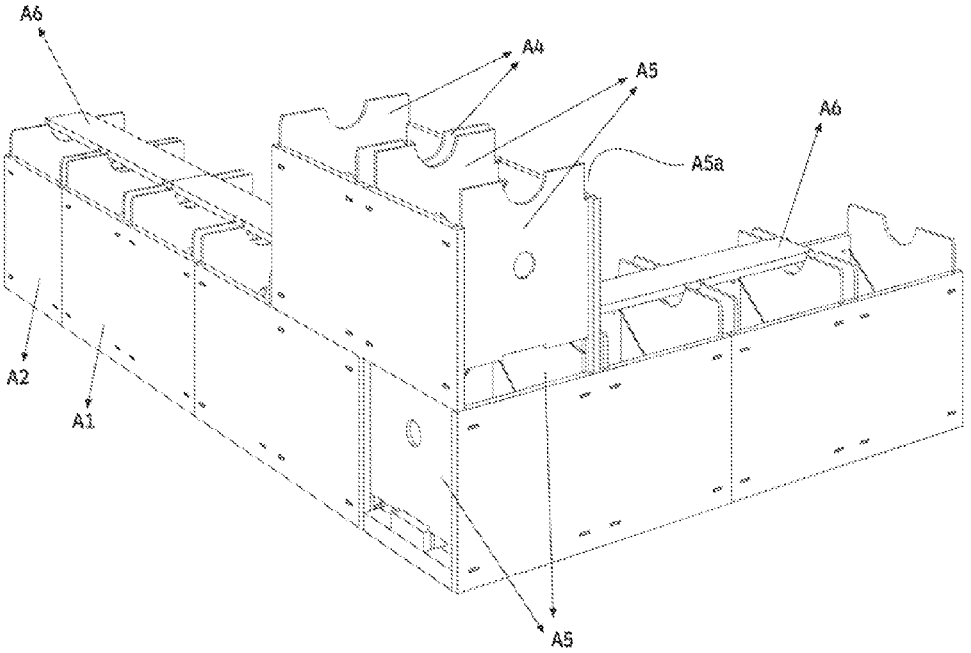
FIG. 17: Perspective view of the A-typed demountable foldable brick and the wall building system, which is the subject of this invention, showing how the final wall corner is formed.

A wall corner is built by combining two foldable brick modules at a vertical angle without leaving any space at the overlapping corners. As shown in FIGS. 16, 17, 18, 19, in a way to cover the complete half of the rear wall of the left brick body (A1), it is placed in a position to form a strength angle with the right side of the other foldable brick unit and onto these two bricks, a single foldable brick module is placed in a way to cover the half of these two brick units right in the middle. This connection is quite simple: For this, corner tongue beam (A5) is placed only on the corner forming other halves of the brick bodies (1) that will form the corner. The brick body fitting slot (A5*a*) located on the upper outer edge of this corner tongue (A5), enters into the inner cavity of the foldable brick unit stacked on top and ensures a firm (zip and connection. (FIGS. 16 and 17)

Figure 18:
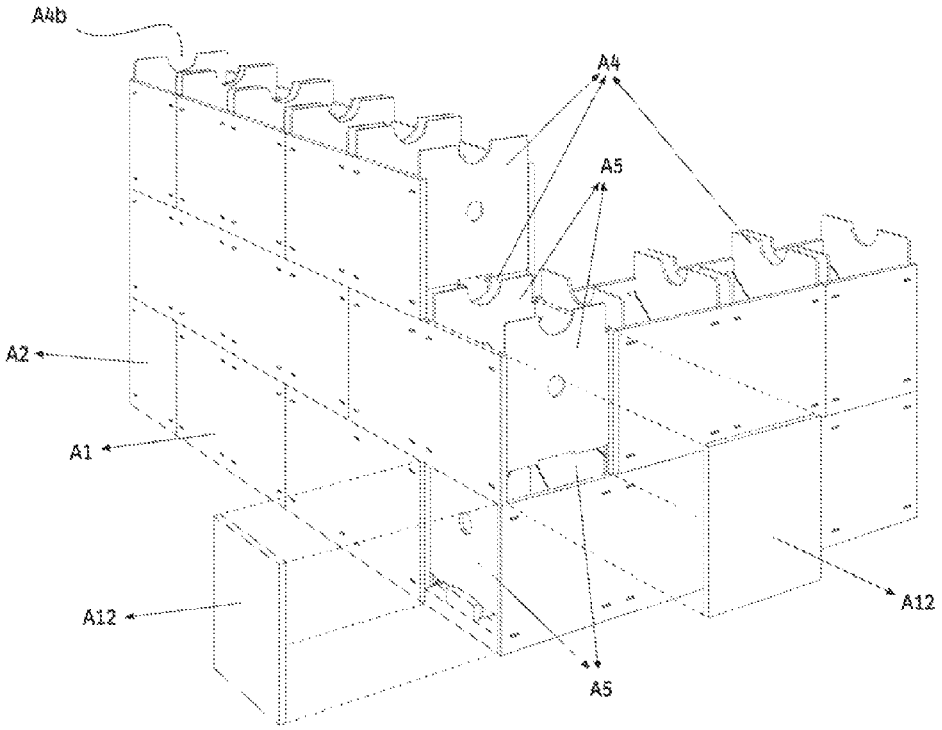
FIG. 18: Perspective view of the A-typed demountable foldable brick and the wall building system, which is the subject of this invention, showing the uncovered surfaces of the foldable brick's side wall during the formation of the wall corner and showing its covered phase.
Figure 19:
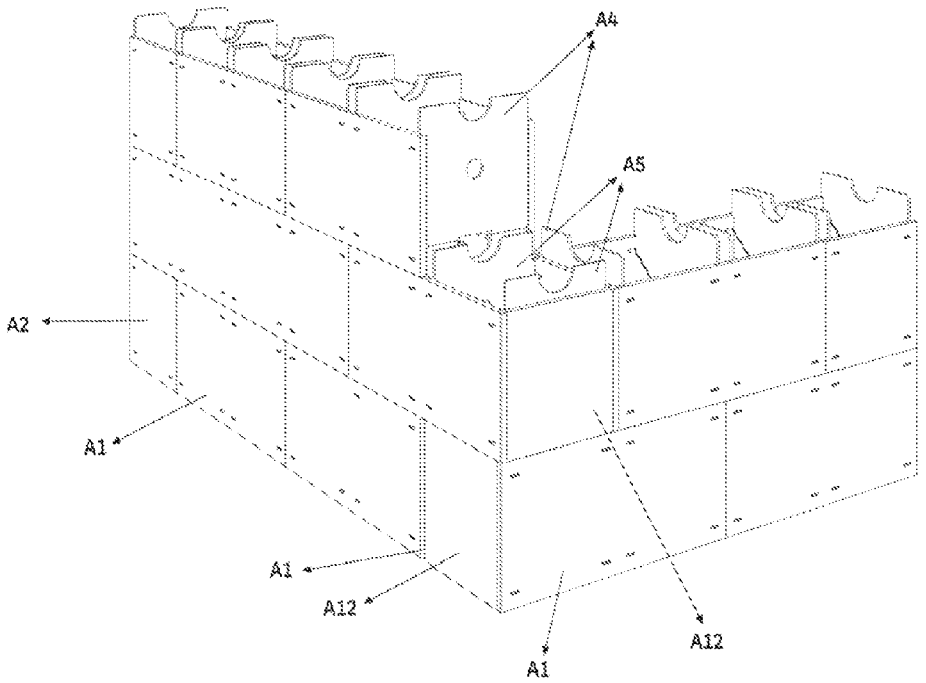
FIG. 19: Perspective view of the A-typed demountable foldable brick and the wall building system, which is the subject of this invention, showing the completed wall corner after the caps are also installed.

The final stage is the aesthetic stage, if desired, includes the mounting of the caps (A12). This procedure is also relatively simple; to ensure aesthetic integrity, applied by fitting the caps onto the outer edge of the exposed foldable brick body (A1, 2) with a double-sided tape if the wall system is to be removed/dismounted again in a short time or with an adhesive compatible with the corresponding material if it is to be permanent by fitting the caps onto the outer surfaces of the tongue (5/4) and onto the corresponding cavity from inside to outside. (FIGS. 18, 19)

The second connection technique of the brick principle, which is a subject for the invention, are shown in the Group C figures. Unlike the other interior connecting/stretching principles, this technique is based on exterior encirclement.

The most advantageous part of this technique is; every single parts of the foldable brick unit's can be totally demounted. Thus, the workmanship cost in production is minimized and it is useful for the users that maintenance or renewal procedures are applied to the relevant parts.

So, there is an opportunity for the ultimate user to change/renew only the related part, not the whole part, of the default foldable brick unit.

Furthermore, in this technique, the volume that the foldable brick system covers, is equal to the 8/1 volume of the setup. In this technique, (Group C figures) there is not any connection (fixation) before setup. Previous fitting-interlocking principle of the foldable bricks and wall building system, which is subject to invention, is entirely same. Herein there is not just the principle of folding but folding by separating to its parts and preserving principle.

Figure 36:
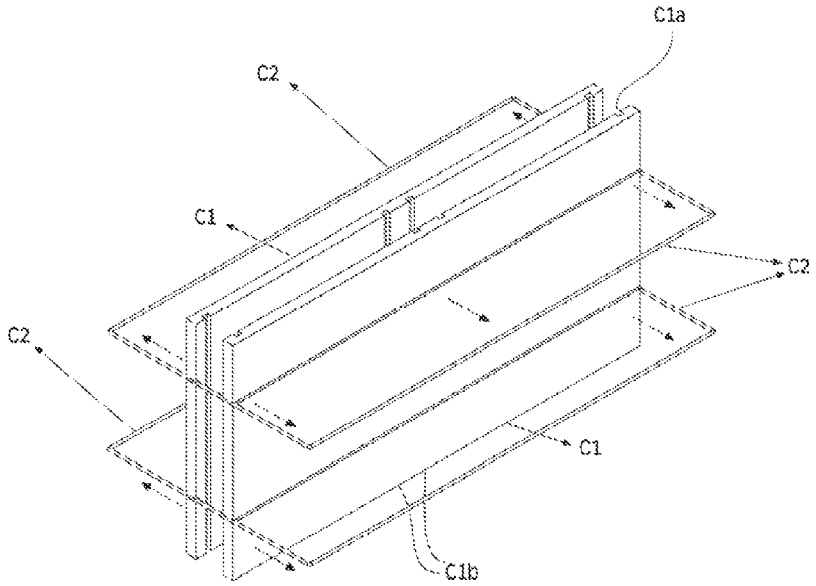
FIG. 36: It is an indicative perspective view of the invention subject detachable C-typed foldable brick's, wire rope frames' front back brick body's exterior side corners placing to the wire frame holes brick bodies's pushing from two opposite directions, from interior to exterior and its encirclement from the wire rope frame.

A channel, is opened thoroughly to the brick body (C1) including outside surfaces, except inner surface, and that channel is as the thickness and depth of the rope or wire frame (C2) that makes the related encircling/enfolding to the outside surface of the brick body (C1) at the horizontal axis. The wire frame (C2) whose two ends are fixed, connected, combined or the two ends are combined inextricably by welding, is placed to the related wire frame groove (channel) (C1*b*) by putting on to the front and back brick body upwardly or downwardly (FIGS. 35, 36) The internal surfaces of the brick bodies (C1) are pushed from inside to outside up to the margin of wire frame (C2) by moving away from each other in opposite directions (front and back) while they are corresponding each other. (FIG. 36)

Figure 37:
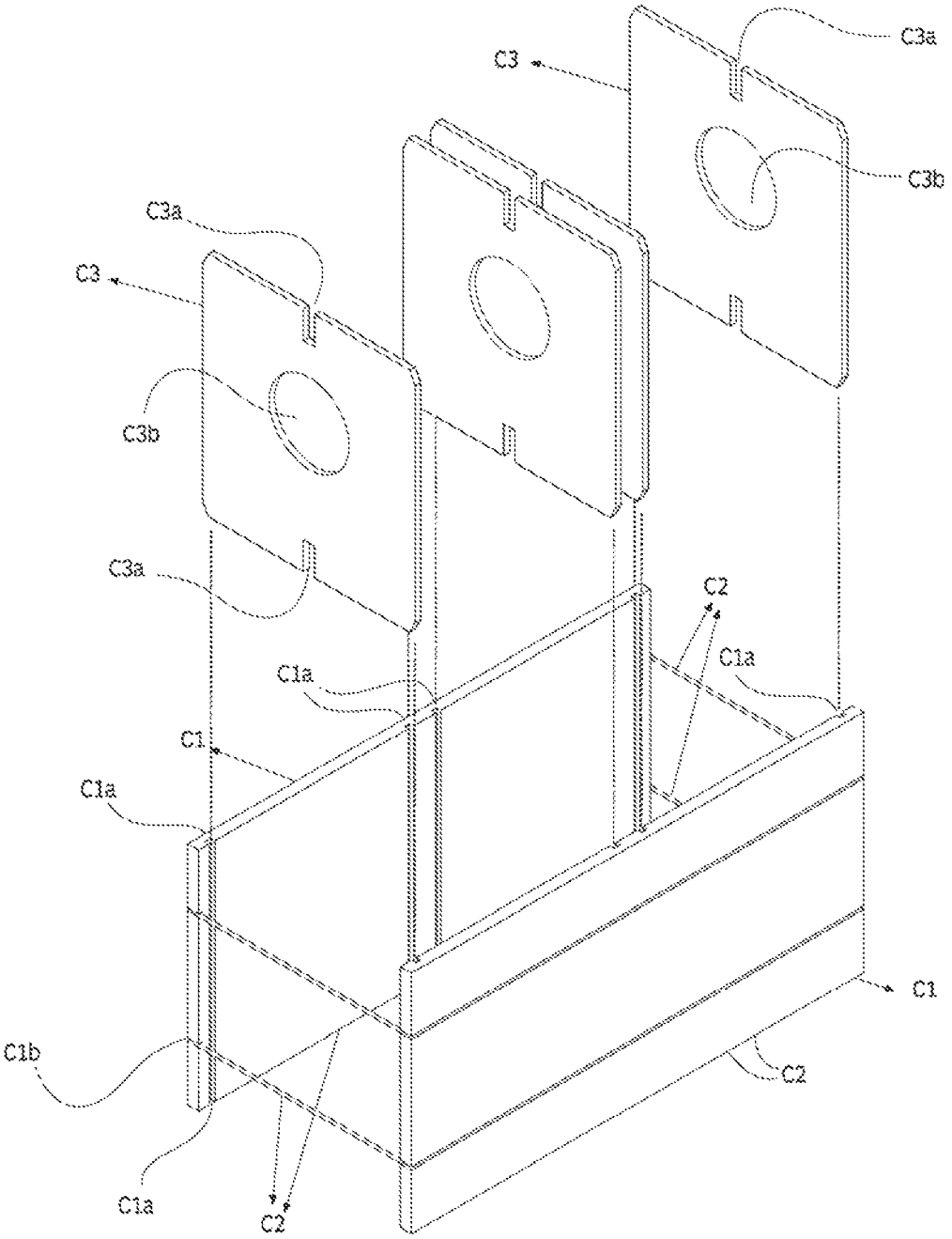
FIG. 37: It is an indicative perspective view of the invention subject detachable C-typed foldable brick's, encirclement and placing tongue beams to the beam grooves to interior surface of the front back brick bodies with wire/rope.

Thus, wire frame (C2) is placed entirely with four directions to the wire frame grooves (C1*b*) at the external surface of brick body (C1). (FIG. 37). After this phase, the tongue beams (C3), which prevent internal direction movement of the brick front/back bodies (C1) that are fixed in external direction, can be inserted.

Figure 38:
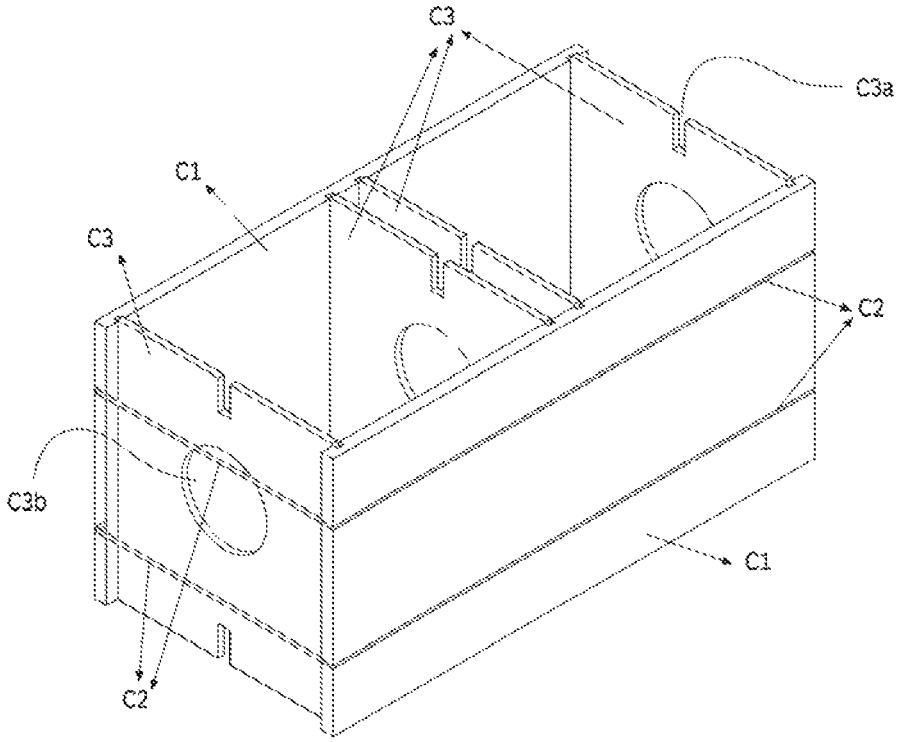
FIG. 38: It is an indicative perspective view of the invention subject detachable C-typed foldable brick's, the ultimate version of the foldable brick unit compressing with the tongue beams and encirclement with the wire/rope frame.

The folding techniques such as the subject of the invention, tongue beams (C3), as in the other the folding techniques which are the subject of the invention, are assembled vertically from top to bottom by putting on the beam groove (C1*a*) (FIGS. 37, 38). Thus, the main brick unit of the wall building system is constituted, the phases of building system are same as the previous technique, (FIGS. 32, 33)

The merging, fitting-interlocking of the foldable bricks which are subject to invention is based on laying together front-back wall foldable bricks bodies and interlocking by placing on related places these upper foldable brick units which are placed/accumulated on these foldable bricks and herein, front-back wall foldable bricks bodies that are fixed with non-stable and rigid rope or tie wire but which can move independently.

Connection/locking, of the foldable bricks, which is the subject this invention, is based on placing the front and rear walls of brick bodies side by side, which are exactly identical to each other and remain independent from each other through a rope connection and locking the upper foldable brick bodies into corresponding slots which are placed/stacked on top of these foldable brick units. In other words, one foldable brick is stacked/placed on top on top of the two bottom foldable bricks in a way to center the full merging axis of these two. Each box shaped foldable brick progressing on the right and left of these foldable bricks, is locked with another foldable brick body on the side and on the top according to the installation principle described above. This way, an architectural wall building system which is fully demountable, consisting of entirely removable parts with a single foldable brick (i.e., a foldable structural unit) that is easy to assemble and disassemble without the use of appropriate equipment, screwdriver, hex key and a similar tools is obtained.

The foldable brick, which is the subject of this invention, can also be used for various furniture products such as tables, coffee tables, desks, bars to function as a base foot; and thanks to its foldable design and the flexible inner connection principle and/or external encircling principle that allows any form, different types of furniture can be produced as coffee tables, chairs, sofas, shelves, table, bed, bunk etc. and surfaces such as fabric, leather, plastic or decorative plates can be used.

The above mentioned preferred applications and the accompanying drawings have been added provide a better understanding of the invention, are not intended to limit the protection scope of the invention. In accordance with the information disclosed with the invention, the changes will be made on the preferred applications and accompanying drawings, should be considered within the scope of protection of the invention.

The invention claimed is:

1. A demountable wall building system comprising, a plurality of foldable bricks, wherein each foldable brick comprises:

two foldable brick bodies that form visible outer wails of each foldable brick;

at least four pairs of high-strength diagonal ropes, forming an internal structure and a main connection of each foldable brick, which is folded and rolled;

a plurality of tongue beams that help the two foldable brick bodies to take the form of a closed block and enables the plurality of foldable bricks to be locked upon each other while the plurality of foldable bricks are stacked;

a beam clamp which locks the plurality of foldable bricks that are placed side by side to each other through the plurality of tongue beams and increases the strength by stabilizing a third axis of each foldable brick;

a corrugated hoard padding box, which has four side surfaces, one bottom surface, and four walls extending from corners to a center of the corrugated board padding box and interlocking with each other diagonally, and which is configured for filling air gaps formed inside each foldable brick after the plurality tongue beams are mounted;

a base that grips each foldable brick of a bottom course and the demountable wall building system from inside; and a plurality of fitted demountable decorative caps to cover edges of the plurality of foldable bricks that are exposed as a result of building a wall with the plurality of foldable bricks.

2. The demountable wall building system according to claim 1, wherein the demountable wall building system in a fielded state, occupies a volume in the range of 1/8$^{th}$ to 1/4$^{th}$ of a mounted state volume.

3. The demountable wall building system according to claim 1, wherein each foldable brick has the ability to be demounted, folded and mounted numerous times.

4. The demountable wall building system according claim 1, wherein fully recyclable materials and techniques are used in the manufacturing of each foldable brick and each foldable brick is made of a light material.

5. The demountable wall building system according to claim 1, wherein a desired acoustic comfort level is maintained through the corrugated board padded box without using any chemical or synthetic filling materials, adhesives, mortar or plaster.

6. The demountable wall building system according to claim 1, wherein each foldable brick body comprises connection holes that allow the two foldable brick bodies to be attached to each other with the at least four pairs of high-strength diagonal ropes to form a front wall and a rear wall by making a simple sailor's knot.

7. The demountable wall building system according to claim 1, wherein each of the two foldable brick bodies, each of the at least pairs of high-strength diagonal ropes, each of the plurality of tongue beams, each beam clamp, each corrugated board padding box, each base, or each of the plurality of fitted demountable decorative caps is replaceable.

8. The demountable wall building system according to claim 1, wherein each foldable brick further comprises a single tongue groove on outer edges of inner surfaces of the two foldable brick bodies and a pair of beam grooves on the right side and the left side of a middle line of each inner surface that allow the plurality of tongue beams to be locked upon and a brick unit to be formed.

9. The demountable wall building system according to claim 1, wherein the plurality of foldable bricks are configured to lock side by side at the bottom and top of the plurality of tongue beams forming vertical edges of the foldable bricks;

wherein each foldable brick further includes a plurality of beam clamp insertion slots for upward alignment, a finger insertion hole that facilitates a demounting process, and an upper corner beam clamp insertion slot which is used as a wiring groove.

10. The demountable wall building system according to claim 1, wherein a plurality of tongue beam clamping grooves are provided on outer edges of each beam clamp which locks into a plurality of slots located at bottom and upper edges of the plurality of tongue beams at a horizontal plane.

11. The demountable wall building system according to claim 1, wherein each beam clamp is used perpendicular to each plurality of tongue beams in order to increase the activity of interlocking.

12. The demountable wall building system according to claim 1. wherein each corrugated board padding box is used in permanent wall structures.

13. The demountable wall building system according to claim 1, wherein a thickness of each foldable brick body is between 6-20mm.

14. The demountable wall building system according to claim 1, wherein a flexible inner-connection structure is formed by making a simple sailor's knot after inserting each pair of high-strength diagonal ropes through a pair of holes, opened on each foldable brick body.

15. The demountable wall building system according to claim 1, wherein each foldable brick body is made of hard or elastic resilient material chosen from a group consisting of baked clay, ceramic, metal, glass, carian, PVC foam sheet, acrylic, strong cardboard, laminated MDF, laminated clipboard, plywood, and solid wood.

16. A demountable wall building system comprising a plurality of foldable bricks, wherein each foldable brick comprises:

two foldable brick bodies that form visible outer walls of each foldable brick;

at least two pairs of pliable string ropes, forming an internal structure and a main connection of each foldable brick;

an insulation plate for increasing the insulation property of each foldable brick, and is fixed into an interior surface of each of the two foldable brick bodies;

a plurality of tongue beams that help the two foldable brick bodies to take the form of a closed block and enables the plurality of foldable bricks to be locked upon each other while the plurality of foldable bricks are stacked; and a beam clamp which locks the plurality of foldable bricks that are placed side by side to each other through the plurality of tongue beams and increases the strength by stabilizing a third axis of each foldable brick.

17. The demountable wall building system according to claim 16, wherein each insulation plate is configured to provide sound, heat and light insulation and the raw material of said insulation plate can be varied according to the expectation level and desire.

18. The demountable wall building system according to claim 16, wherein the plurality of foldable bricks are constituted on a single line with four connection ends of each pair of pliable string ropes for constituting a front wall and a back wall.

19. A demountable wall building system comprising a plurality of foldable bricks, wherein each foldable brick comprises:

two foldable brick bodies that form visible outer wails of each foldable brick, wherein each of the two foldable brick body has an inside surface and an outside surface to the inside surface, the inside surfaces of the two foldable brick bodies face each other;

a wire frame externally encircling each foldable brick, wherein two ends of the wire frame are connected to each other;

a wire frame groove formed on the outside surface of each of the two foldable brick bodies and receiving a part of the wire frame;

a plurality of beam grooves longitudinally formed on the inside surface of each of the two foldable brick bodies;

a plurality of tongue beams inserted in the beam grooves to help the two foldable brick bodies to take the form of a closed block and enable the plurality of foldable bricks to be locked upon each other while the plurality of foldable bricks are stacked, wherein each tongue beam comprises two opposite beam insert slots on the top and bottom of the tongue beam, respectively, a beam clamp which locks the plurality of foldable bricks that are placed side by side to each other through the plurality of tongue beams and increases the strength by stabilizing a third axis of each foldable brick.

* * * * *